US012102221B2

(12) United States Patent
König et al.

(10) Patent No.: US 12,102,221 B2
(45) Date of Patent: Oct. 1, 2024

(54) APPARATUS AND METHOD FOR FORMING BRISTLE BUNDLES, BRUSH MANUFACTURING MACHINE, USE OF AN APPARATUS FOR FORMING BRISTLE BUNDLES, BRUSH, COMPUTER PROGRAM AND COMPUTER-READABLE MEDIUM

(71) Applicant: Zahoransky AG, Todtnau (DE)

(72) Inventors: Marc König, Freiburg (DE); Ingo Kumpf, Todtnau (DE); Florian Kiefer, Frohnd (DE)

(73) Assignee: Zahoransky AG, Todtnau (DE)

( * ) Notice: Subject to any disclaimer, the term of this patent is extended or adjusted under 35 U.S.C. 154(b) by 722 days.

(21) Appl. No.: 17/286,145

(22) PCT Filed: Oct. 21, 2019

(86) PCT No.: PCT/EP2019/078604
§ 371 (c)(1),
(2) Date: Apr. 16, 2021

(87) PCT Pub. No.: WO2020/083848
PCT Pub. Date: Apr. 30, 2020

(65) Prior Publication Data

US 2021/0353047 A1 Nov. 18, 2021

(30) Foreign Application Priority Data

Oct. 22, 2018 (DE) ..... 102018126202.7
Oct. 21, 2019 (DE) ..... 102019128360.4

(51) Int. Cl.
*A46D 3/04* (2006.01)
*A46B 9/02* (2006.01)
(Continued)

(52) U.S. Cl.
CPC ..... *A46D 3/045* (2013.01); *A46B 9/025* (2013.01); *A46B 9/04* (2013.01); *A46D 1/0253* (2013.01);
(Continued)

(58) Field of Classification Search
CPC .... A46D 1/08; A46D 3/04; A46B 3/06; A46B 9/028; A46B 9/04
See application file for complete search history.

(56) References Cited

U.S. PATENT DOCUMENTS 3,847,532 A * 11/1974 Bischoff ..... A46D 3/047 425/398
4,132,449 A * 1/1979 Bergman ..... A46D 3/045 300/4
(Continued)

FOREIGN PATENT DOCUMENTS

CN 102551339 7/2012
CN 101472504 6/2013
(Continued)

*Primary Examiner* — Michael D Jennings
(74) *Attorney, Agent, or Firm* — Volpe Koenig

(57) ABSTRACT

An apparatus (1) for forming bristle bundles (2) is inter alia proposed as an improvement in the technical field of manufacturing and designing brushes. The apparatus (1) includes at least one bundle pocket (3) which is specified for receiving bristle bundles (2) to be formed. The bundle pocket (3) has a common bundle receptacle portion (50) for unifying at least two bristle bundles (2). The bundle pocket (3) and the bristle bundles (2) situated therein are heated by the heating apparatus (4) of the apparatus (1) so as to set the shaping of the bristle bundles (2) that is predefined by the bundle pocket (3) and the displacement means (7).

31 Claims, 10 Drawing Sheets

(51) Int. Cl.

| | |
|---|---|
| ***A46B 9/04*** | (2006.01) |
| ***A46D 1/00*** | (2006.01) |
| ***A46D 1/08*** | (2006.01) |
| ***A46D 3/08*** | (2006.01) |

(52) U.S. Cl.
CPC ..... *A46D 1/08* (2013.01); *A46D 3/04* (2013.01); *A46D 3/08* (2013.01); *A46B 2200/1066* (2013.01)

(56) References Cited

U.S. PATENT DOCUMENTS

| | | | | |
|---|---|---|---|---|
| 4,291,431 | A | 9/1981 | Lewis, Jr. | |
| 4,348,060 | A | 9/1982 | Lewis, Jr. | |
| 4,696,519 | A | 9/1987 | Lewis Jr. | |
| 4,944,625 | A | 7/1990 | Futter et al. | |
| 4,978,242 | A | 12/1990 | Konose | |
| 10,426,256 | B2 * | 10/2019 | Boucherie | A46B 3/06 |
| 2002/0092109 | A1 * | 7/2002 | Edwards | B29C 65/08 15/207.2 |
| 2008/0048486 | A1 | 2/2008 | Boucherie | |
| 2009/0007365 | A1 | 1/2009 | Egner-Walter et al. | |
| 2012/0224909 | A1 * | 9/2012 | Saravia Castillon | F04B 15/02 401/118 |
| 2013/0139338 | A1 * | 6/2013 | Hess | A46D 3/04 15/167.1 |
| 2015/0130259 | A1 * | 5/2015 | Birk | A46D 1/08 300/19 |
| 2015/0165740 | A1 | 6/2015 | Ganninger et al. | |
| 2016/0015162 | A1 * | 1/2016 | Kumpf | A46D 1/08 300/12 |
| 2017/0340098 | A1 | 11/2017 | Cline et al. | |
| 2017/0367474 | A1 * | 12/2017 | Machlitt | A46B 9/005 |
| 2018/0153292 | A1 | 6/2018 | Dovellos et al. | |
| 2019/0090623 | A1 * | 3/2019 | Görich | A46B 3/005 |

FOREIGN PATENT DOCUMENTS

| | | |
|---|---|---|
| CN | 103671691 | 3/2014 |
| CN | 101254047 | 9/2014 |
| CN | 205831421 | 12/2016 |
| CN | 112867417 | 5/2021 |
| DE | 4114136 | 11/1992 |
| DE | 102007014675 | 10/2007 |
| DE | 102012010415 | 11/2013 |
| DE | 202014006582 | 1/2015 |
| DE | 102016004500 | 10/2017 |
| DE | 102016014653 | 2/2018 |
| DE | 102016011337 | 3/2018 |
| EP | 2420157 | 2/2012 |
| JP | H09252845 | 9/1997 |
| WO | 2007087694 A1 | 8/2007 |

* cited by examiner

APPARATUS AND METHOD FOR FORMING BRISTLE BUNDLES, BRUSH MANUFACTURING MACHINE, USE OF AN APPARATUS FOR FORMING BRISTLE BUNDLES, BRUSH, COMPUTER PROGRAM AND COMPUTER-READABLE MEDIUM

TECHNICAL FIELD

The invention relates to an apparatus and to a method for forming bristle bundles, to a brush manufacturing machine having an apparatus of this type, as well as to the use of such an apparatus in the manufacture of brushes.

BACKGROUND

Brushes, for example toothbrushes, are offered in a large variety for the widest range of applications. The brushes offered herein are significantly distinguished from one another by way of their design. The design herein can also relate to technical aspects of the brushes that can positively influence the properties of the brushes. It is thus consequently not least the design of the brushes that represents a substantial buying criterion from the point of view of the consumers.

Accordingly, brush manufacturers increasingly undertake efforts to individualize the brushes offered by said manufacturers by way of a complex design, so as to on account thereof make the brushes more attractive to the consumers. It has become commonplace herein, for example, for brushes to be provided with a bristle complement from bristle filaments of different colors, or else for the brush handles and brush heads of the brushes to be dissimilarly designed in terms of the shape and color thereof. Moreover, different materials are combined with one another in order for the brushes to be individualized.

While there are thus diverse possibilities for designing brushes, there continues to be a demand for possibilities in terms of individualizing brushes.

SUMMARY

It is therefore an object of the invention to widen the pre-existing design possibilities for individualizing brushes.

In order for this object to be achieved, an apparatus for forming bristle bundles which has one or more of the means and features disclosed herein directed toward an apparatus of this type is proposed.

In order for the object to be achieved, an apparatus for forming bristle bundles of a bristle complement of a brush that comprises at least two bristle bundles is proposed, wherein the apparatus has at least one bundle pocket having at least two bundle receptacles configured therein and a heating apparatus by way of which the bristle bundles that have been incorporated into the bundle receptacles are able to be heated. The bundle receptacles are bundle-forming and, under the effect of heat dissipated by the heating apparatus, are specified for forming bristle bundles that have been incorporated into the bundle receptacles in comparison to the shape of said bristle bundles prior to being introduced into the bundle receptacles so as to set the shaping of the bristle bundles that have been incorporated into the bundle receptacles to the shaping predefined by the bundle receptacles. The bundle pocket has according to the invention at least two bundle receptacles which open into a common bundle receptacle portion. Additionally or alternatively thereto, the bundle pocket can have at least one bundle receptacle which is specified for receiving at least two bristle bundles and comprises a common bundle receptacle portion for at least two bristle bundles. In this way it is possible to achieve a brush having a bristle complement which has at least two bristle bundles which are unified in a common bundle portion.

The heating apparatus can be specified for heating the at least one bundle pocket. In one embodiment, the bundle pocket is provided with an introduction opening for a bristle bundle and with at least one lateral piercing. At least one bristle bundle can be introduced into the bundle pocket through the introduction opening of the bundle pocket. A displacement the apparatus for profiling a bristle bundle that has been introduced into the bundle pocket can be incorporated into the bundle pocket through the lateral piercing of the bundle pocket.

The apparatus by the bundle pocket, proceeding from a non-deformed initial shape, is specified for forming a bristle bundle that has been introduced into the bundle pocket to a desired target shape under the effect of heat which by the heating apparatus is dissipated to the bundle pocket and thus also to the bristle bundle situated therein.

An apparatus for forming bristle bundles that permits an individualization of bristle bundles and thus ultimately widens the design possibilities for individualizing brushes which are equipped with the formed bristle bundles is achieved in this way. The apparatus according to the invention moreover also offers the possibility for improving the effectiveness of bristle bundles by imparting a technically effective shape. Depending on the type of application, it is conceivable for the bristle bundles to be shaped in the most varied ways. For example, it is thus conceivable for bristle bundles which taper in a particularly sharp manner, bristle bundles of which the bristle filaments follow a helical line, or else bristle bundles which at one end thereof have a first cross-sectional shape and at the second end thereof have a second cross-sectional shape while the cross section of the bristle bundle continually varies from the first end toward the second end to be manufactured.

The shape predefined by the bundle pocket is imparted to the bristle bundle that has been introduced into the bundle pocket of the apparatus. The as yet non-deformed bristle bundle, prior to the latter being introduced into the bundle pocket, thus can have a cylindrical or a slightly conical initial shape, for example. Should the bundle pocket, in particular a receptacle of the bundle pocket, into which the bristle bundle is introduced, now have a shape which deviates from this initial shape, the bristle bundle in terms of the shape or design thereof is forcibly adapted to the shape predefined by the bundle pocket when said bristle bundle is introduced into the bundle pocket.

The shape which is predefined by the bundle pocket and which has been assumed by the bristle bundle situated in the bundle pocket can be set by the heat of the heating apparatus that by way of the bundle pocket has been dissipated to the at least one bristle bundle situated in said bundle pocket. The heat dissipated by the heating apparatus has the effect of a kind of low-tension thermal stress relief of the bristle bundle that is held in a deformed manner in the bundle pocket. The bristle filaments of the bristle bundle that are held in a deformed manner in the bundle pocket and/or by the bundle pocket thus can correspondingly change their structure under the effect of the heat, due to which the varied shaping of the bristle bundle can ultimately be set.

The displacement means can be introduced into the bundle pocket, and herein between bristle filaments of the at least one bristle bundle situated in the bundle pocket, by way of the lateral piercing of the bundle pocket. Bristle filaments of the bristle bundle are laterally displaced due to the displacement means. The bristle bundle that is situated in the bundle pocket, with the aid of the displacement means, can be provided with a clearance that is configured within the bristle bundle. The heat dissipated by the heating apparatus herein has the effect that the clearance generated within the bristle bundle by the displacement means is preserved after the bristle bundle has been removed from the bundle pocket. It can be advantageous herein for the displacement means to be left in the displacement position thereof within the bundle pocket, while the bundle pocket and the bristle bundle situated therein are heated by the heating apparatus. The displacement means can be able to be introduced, and/or be introduced, into the bundle pocket transversely or orthogonally to an introduction direction of a bristle bundle.

Bristle bundles of a particularly complex design which enable a high degree of individualization of brushes equipped therewith can thus be generated with the aid of the apparatus for forming bristle bundles.

The bundle pocket can have two mutually opposite lateral piercings. The two piercings can be disposed on the bundle pocket such that a receptacle space of the bundle pocket into which the at least one bristle bundle can be introduced lies between the two piercings. The displacement the apparatus by way of the one piercing can be pushed through the receptacle space of the bundle pocket and exit the bundle pocket through the other piercing of said bundle pocket. It is thus ensured that the displacement means completely penetrates through the bundle pocket, in particular the receptacle space thereof, and on account thereof generates the desired clearance within the bristle bundle by displacing the bristle filaments of a bristle bundle situated in the bundle pocket.

The at least one piercing of the bundle pocket can be so large that said piercing generates one clearance in the bristle bundle that is delimited by a first closed bundle portion which lies between the clearance and a free end of the bristle bundle, on the one hand, and by a second closed bundle portion which lies between the clearance and an end of the bristle bundle that is proximal to the bristle carrier, on the other hand.

The closed bundle portion which is disposed so as to neighbor the free end of the bristle bundle, like the closed bundle portion which is disposed so as to neighbor the end of the bristle bundle that is proximal to the bristle carrier, can have a length which, for example, is 5% of an overall length of the bristle bundle when measured in the direction of longitudinal extent of the bristle filaments of the bristle bundle.

When applied to the bundle pocket, this can mean that a first closed portion, or a piercing-free portion, of the bundle pocket that is disposed between the piercing and the introduction opening of the bundle pocket, and a second closed portion, or a piercing-free portion, of the bundle pocket that is disposed between the piercing and an end of the bundle pocket that is disposed so as to be opposite the introduction opening of the bundle pocket, have in each case a length of at least 5% of an overall length of the bundle pocket.

The at least one piercing of the bundle pocket in one embodiment of the apparatus can have a length, measured between the introduction opening of the bundle pocket and an end of the bundle pocket that is disposed opposite the introduction opening of the bundle pocket, which is between 10% and 90% or 95%, in particular between 50% and 90%, of the overall length of the bundle pocket measured in the same direction.

In order to be able to close the at least one piercing of the bundle pocket while a bristle bundle is being introduced into the bundle pocket, it can be advantageous for the apparatus to have at least one closure means. The closure the apparatus can be specified for at least temporarily closing the at least one lateral piercing of the at least one bundle pocket. By way of the closure means it can be effectively prevented that bristle filaments of a bristle bundle that has been introduced into the bundle pocket are inadvertently pushed out, or make their way out, of the piercing of the bundle pocket.

As has already been discussed above, the object is achieved by an apparatus for forming bristle bundles of a bristle complement of a brush, said apparatus having at least some of the means and features described herein directed toward an apparatus of this type. In order for the object to be achieved, an apparatus for forming bristle bundles of a bristle complement of a brush that comprises at least two bristle bundles is thus in particular proposed, said apparatus having at least one bundle pocket having at least two bundle receptacles configured therein and a heating apparatus. Bristle bundles that have been incorporated into the bundle receptacles can be heated by the heating apparatus. The bundle receptacles are bundle-forming and, under the effect of heat dissipated by the heating apparatus, specified for forming bristle bundles that have been incorporated into the bundle receptacles in comparison to the shape of said bristle bundles prior to being introduced into the bundle receptacles so as to set the shaping of the bristle bundles that have been incorporated into the bundle receptacles to the shaping predefined by the bundle receptacles.

The bundle bores herein can be combined in at least one group, wherein a group comprises a number of bundle receptacles that corresponds to a number of bristle bundles of a bristle complement of which the bristle bundles are to be formed by the apparatus. In this way, all of the bristle bundles of the bristle complement of a brush can be formed in one operating step using the apparatus for individualizing the brush.

To this end, the bundle receptacles within one group are expediently disposed like the bristle bundles in the bristle complement of the brush to be machined.

At least one bundle receptacle of the bundle pocket of the apparatus can have at least two cross sections which in terms of a longitudinal axis of the bundle receptacles are axially spaced apart from one another and which differ from one another in terms of shape and/or size. An apparatus which permits a diverse individualization of brushes is achieved in this way.

In one embodiment of the previously described apparatus, a bundle receptacle of the bundle pocket has an introduction duct which opens into at least two ducts of the bundle receptacle that are downstream of the introduction duct. Bristle bundles which spread open in the profile thereof can be formed using such an apparatus. The downstream ducts of the bundle receptacles can have longitudinal axes which are mutually oriented at a defined angle, in particular at an acute angle. A bristle bundle which has a Y-shaped design can thus be formed, for example.

In one embodiment of the previously described apparatus, at least one bundle receptacle of the bundle pocket has a bundle receptacle portion which is defined by the envelope faces of two cones or truncated cones. Longitudinal central axes of the cones or truncated cones herein can be congruent. The cones or truncated cones may have different radii. A bristle bundle having a chalice-shaped bundle portion can be generated using such an apparatus.

In one embodiment of the previously described apparatus, at least one bundle receptacle of the bundle pocket, in particular proceeding from a cross section of the bundle receptacles, can fan out or spread open so as to be preferably chalice-shaped and/or conical.

In order for bristle bundles which are unified with one another in a bundle portion to be generated, the bundle pocket of the apparatus has according to the invention at least two bundle receptacles which open into a common bundle receptacle portion.

In order for bristle bundles which are unified with one another in a bundle portion to be generated, the bundle pocket additionally or alternatively can according to the invention also have at least one bundle receptacle which is specified for receiving at least two bristle bundles and which comprises a common bundle receptacle portion for at least two bristle bundles.

In order for an ideally rapid forming of bristle bundles to be facilitated, the at least one bundle pocket can have at least one heat exchanger element which facilitates an exchange of heat. With the aid of the at least one heat exchanger element of the bundle pocket, the bundle pocket by the heating apparatus can be more rapidly brought to the temperature required for the forming of the bristle bundles. The at least one heat exchanger element of the bundle pocket, upon successful forming of a bristle bundle, can accelerate cooling of the bundle pocket and of a bristle bundle situated therein.

A cooling and/or heating rib and/or a cooling and/or heating fin can serve as the heat exchanger element, for example.

Alternatively or additionally to the at least one heat exchanger element, the bundle pocket can have a surface structure which facilitates an exchange of heat. It is thus possible, for example, for the bundle pocket on the external side thereof to be provided with a surface roughness Ra of 1.6 μm to 50 μm. An external surface of the bundle pocket can be enlarged due to the surface roughness, this accelerating a take-up of heat when heating the bundle pocket and likewise a heat dissipation when cooling the bundle pocket.

With a view to preferably fully automatic handling of bristle bundles and/or bundle pockets in the use of the apparatus, the latter can have at least one bundle gripper and/or at least one bundle pocket gripper. In one embodiment of the apparatus, the at least one bundle gripper as well as the at least one bundle pocket gripper can be movable between an initial position and a machining position.

In order for an introduction of bristle bundles into the at least one bundle pocket of the apparatus to be facilitated, the at least one bundle pocket gripper and/or the at least one bundle gripper, can preferably in each case be assigned one vibrator. The bundle pocket and/or a bristle bundle held by the bundle gripper can be set in vibration with the aid of the at least one vibrator. Due to the vibrations, the bristle filaments of the at least one bristle bundle can slide more easily into the bundle pocket.

The apparatus can have a guide for a bundle gripper, for example the bundle gripper already mentioned above, a guide for the at least one displacement means, and/or a guide for the at least one closure means, already mentioned above, of the apparatus.

In order to be able to uniformly and/or swiftly heat the bundle pocket for forming bristle bundles, the at least one bundle pocket can have a wall having a constant and preferably ideally thin wall thickness. An inner contour of the bundle pocket herein can be adapted to an outer contour of the bundle pocket. An outer contour of the bundle pocket herein can be identical to it in the contour of the bundle pocket.

The introduction of bristle bundles into the bundle pocket is facilitated when the introduction opening of the at least one bundle pocket is provided with an introduction funnel. The bundle pocket can furthermore form or be a preferably materially homogenous, monolithic unit. A particularly high degree of design freedom in terms of the shaping of the bundle pocket can be achieved when the bundle pocket is 3D-printed. In this way, the bundle pockets may have particularly complex internal structures. Bundle pockets which have a helical internal structure for receiving a bristle bundle are thus conceivable, said bundle pockets by virtue of the shaping thereof imparting a helical target shape to a bristle bundle disposed therein for forming.

Depending on the specific application, it can be advantageous for bristle bundles that have been formed with the aid of the bundle pocket to still be post-machined. For this purpose, the at least one bundle pocket of the apparatus can have an exit opening which is preferably disposed in or on a side of the bundle pocket that lies opposite the introduction opening of the bundle pocket. Free filament ends of a bristle bundle that is disposed in the bundle pocket can protrude from the bundle pocket through this exit opening and be accessible for post-machining, for example by machining by cutting and/or grinding.

It can furthermore be advantageous for the apparatus to have at least one machining means, in particular a cutter and/or a grinder, for machining a bristle bundle.

In order for cooling of the bundle pocket and of a bristle bundle situated therein to be accelerated, the apparatus can furthermore have a cooling apparatus.

In one embodiment of the apparatus, the heating apparatus extends across a region which covers an annular segment with an angular range between 180° and 270°. A cooling apparatus of the apparatus, for example the cooling apparatus already mentioned above, can extend across a region which covers an annular segment with an angular range between 180° and 90°.

In one embodiment of the apparatus, the heating apparatus has a heating plate which preferably extends across a region which covers an annular segment with an angular range between 180° and 270°, for example. A cooling apparatus of the apparatus, for example the cooling apparatus already mentioned above, can have a cooling plate which preferably extends across a region which covers an annular segment with an angular range between 180° and 90°, for example.

This type of heating apparatus and cooling apparatus is particularly suitable for use in a brush manufacturing machine as will be described in more detail hereunder and which has a rotary indexing table by which bundle pockets and bristle bundles situated therein can be transported between different stations of the brush manufacturing machine.

In one embodiment of the apparatus it is provided that said apparatus has a bundle spreading apparatus. The bundle spreading apparatus is specified for spreading in particular neighboring bristle bundles prior to being introduced into the bundle pocket, in particular into the bundle receptacles. This can simplify the introduction of the bristle bundles into the bundle pocket. A spacing between two neighboring bundles can be enlarged by spreading the bristle bundles.

The apparatus can furthermore have a humidification apparatus for humidifying and/or steam-treating the bristle bundles. Bristle filaments of which the bristle bundles are composed can be held together by humidifying and/or steam-treating the bristle bundles. The bristle bundles can thus at least temporarily assume a more compact shape. This facilitates an introduction of the bristle bundles into the bundle pocket, in particular into the bundle receptacles of the bundle pocket.

The apparatus can have a controller, for example the controller already mentioned above, which is specified for actuating the heating apparatus such that the bristle bundles in the bundle pocket are heated according to defined thermal profile curves. The heating apparatus and/or the bundle pocket, here in particular the bundle receptacles, can be specified for heating the bristle bundles by thermal conduction by mechanical contacting, by induction and/or convection, preferably by a temperature-controlled fluid, and/or by thermal radiation.

A cooling apparatus, for example the cooling apparatus already mentioned above, of the apparatus can be specified for cooling the bristle bundles by a temperature-controlled fluid, in particular by compressed air and/or by nitrogen. To this end, the cooling apparatus can comprise a cold air gun, a vortex tube and/or a cyclone tube, for example.

The bundle pocket can be manufactured by eroding and/or by 3D-printing and/or by cutting and/or from thin layers and/or sheets which are subsequently connected to one another.

The bundle receptacles of the bundle pocket can have a surface roughness of at most 6.3 μm. This can facilitate an introduction of the bristle bundles into the bundle receptacles. The bundle receptacles in the push-fitting direction of the bristle bundles can furthermore be ground, in particular flow ground, and/or polished. This can also reduce a resistance when introducing the bristle bundles and facilitate a targeted introduction of the bristle bundles into the bundle receptacles. It is furthermore possible for the bundle receptacles to have a surface coating so as to reduce the surface roughness of said bundle receptacles.

The apparatus can have a suction apparatus by way of which a negative pressure is able to be applied to the bundle pocket, in particular to the bundle receptacles. This can also facilitate an introduction of the bristle bundles into the bundle pocket, in particular into the bundle receptacles. The bristle bundles can be suctioned into the bundle receptacles of the bundle pockets due to the applied negative pressure.

The bundle pocket can be perforated, in particular laterally perforated. This can facilitate an exchange of heat when heating and subsequently cooling the bristle bundles by way of the bundle pocket. The bundle pocket can furthermore have at least one flow duct. It is thus possible for a heated and/or a cooled fluid for the thermal input and/or for cooling the bristle bundles to be supplied by way of the bundle pocket, for example.

The apparatus can furthermore have a discharge apparatus by way of which fluid, in particular warm air, heated with the heating apparatus can be discharged into the environment. When the apparatus, in particular the heating apparatus, is to be operated by recirculation, it can be advantageous for the apparatus, in particular the heating apparatus, to have a closed system, in particular a recirculating air system, in which fluid heated by the heating apparatus, in particular heated air, can circulate. The use of a closed system, for example a recirculating air system, can assist in saving energy when heating the bundle pocket and the bristle bundles situated therein.

In order for a thermal input into the bundle pocket to be monitored, the apparatus can have a controller, for example the controller already mentioned above, and/or a regulator unit.

The apparatus can furthermore have at least one temperature sensor, by way of which a temperature of the bundle pocket is able to be determined. In one preferred embodiment of the apparatus, a plurality of temperature sensors by way of which the temperature of the bundle pocket is able to be determined at different locations is provided. A more exact distribution of temperature at and/or at least indirectly also in, the bundle pocket can be determined using a plurality of temperature sensors.

When a temperature-controlled fluid is to be used for heating the bristle bundles situated in the bundle pocket, it can be expedient for the apparatus to have at least one temperature sensor at the heating apparatus and/or in or at an inflow duct and/or in or at an outflow duct.

All of the previously mentioned temperature sensors can be utilized by the controller and/or the regulator unit of the apparatus when monitoring the thermal input into the bundle pocket.

In one embodiment of the apparatus, a cross-sectional area of a bundle receptacle can be at least 20% larger than an overall cross-sectional area of individual bristle filaments which are to be introduced into this bundle receptacle. The bundle receptacle is thus oversized in relation to the bristle bundles, due to which the bristle bundles can be more easily introduced into the bundle receptacle. In one embodiment of the apparatus, at least part of the heating apparatus is integrated in the bundle pocket of the apparatus. This can facilitate an efficient heating of bristle bundles situated in the bundle pocket.

The afore-mentioned object is also achieved by a method for forming bristle bundles, said method having at least some of the means and features described herein directed toward such a method. In order for the object to be achieved, a method for forming bristle bundles of a bristle complement of a brush that comprises at least two bristle bundles is thus in particular proposed, wherein at least two bristle bundles are unified in a common bundle portion. The bristle bundles can be unified in a common bundle portion in particular at the free ends of said bristle bundles.

In one embodiment of the method, at least one bristle bundle, proceeding from a non-deformed initial shape, can be formed to a desired target shape, wherein bristle filaments of the bristle bundle for generating a clearance in the bristle bundle are, preferably laterally, displaced with the aid of a displacement means. The bristle bundle is subsequently heated so as to set the target shape of the bristle bundle and thus the clearance generated in the bristle bundle. In this way, a bristle bundle which is individualized by virtue of the changed shaping thereof, on the one hand, and by virtue of the clearance generated within the bristle bundle, on the other hand, can be achieved, this leading to brushes which are equipped with such a bristle bundle being imparted a particular appearance.

In one embodiment of the method, a clearance which is disposed between a first closed bundle portion and a second closed bundle portion of the bristle bundle can be generated within the bristle bundle. The first closed bundle portion of the bristle bundle can be adjacent to a free end of the bristle bundle. The second closed bundle portion of the bristle bundle can be adjacent to an end of the bristle bundle that is proximal to the bristle carrier and/or proximal to the handle. Furthermore, in one embodiment of the method, a clearance which has a closed cross section that is defined and/or enclosed by bristle filaments of the bristle bundle, and/or which is defined and delimited by bristle filaments of the bristle bundle, can be generated in the bristle bundle.

The apparatus for forming a bristle bundle, which has been described in detail above and in the claims directed toward such an apparatus, can be used for carrying out the method.

In one embodiment of the method it is proposed that at least one of the bristle bundles of the bristle complement of a brush is formed in such a manner that said bristle bundle in terms of the longitudinal axis thereof has two bundle cross sections which are axially spaced apart from one another and which differ from one another in terms of shape and/or size.

In one embodiment of the method, at least one bristle bundle can be imparted a helical, conical, frustoconical or chalice-shaped shape.

In one embodiment of the method, at least one bristle bundle can be spread open due to the forming.

In one embodiment of the method it is provided that the bristle bundles are introduced into bundle receptacles of a bundle pocket, in particular a bundle pocket of the apparatus according to one or more of the features described herein directed toward the apparatus, wherein the bristle bundles prior to being introduced into the bundle receptacles are preferably spread open and/or steam-treated and/or humidified. As has already been discussed above, the spreading of the bristle bundles prior to the latter being pushed into the bundle receptacles can facilitate the push-fitting into the bundle receptacles. This likewise applies in an analogous manner to the steam-treating and/or humidifying of the bristle bundles. This facilitates an improved cohesion of bristle filaments which are combined in one bristle bundle. The bristle bundle can thus at least temporarily be imparted a more compact design due to the steam-treatment and/or humidification, this potentially facilitating an introduction into the bundle receptacles of the bundle pocket.

The cycle time can be reduced and/or the quality of the deformation can be increased when the bristle bundles of the bristle complement are deformed in stages and/or in groups. It is thus possible, for example, for the inner bundles to be first deformed, and for the outer bundles to be subsequently deformed. Both can take place, for example, using two bundle pockets and/or bundle receptacles which are successively used.

In one embodiment of the method, the bristle bundles can be deformed in such a manner that said bristle bundles, in particular by way of the bristle filaments thereof, conjointly represent a logo and/or an image in the bristle complement.

The bristle bundles can be heated according to defined thermal profile curves, this potentially facilitating forming of the bristle bundles and also the setting of the latter.

In one embodiment of the method, the bristle bundles can be heated by a heating apparatus that is integrated in the bundle pocket. It is furthermore possible for the bristle bundles to be heated by thermal conduction, induction and/or convection, preferably by a temperature-controlled fluid, and/or by thermal radiation. In this context, it can be expedient for the apparatus which has already been explained in detail above to have a heating apparatus of which at least part is integrated in the bundle pocket of the apparatus.

The bristle bundles can be cooled with the aid of a temperature-controlled fluid, in particular by compressed air, by nitrogen, and/or by ambient air. A cold air gun, which is also referred to as a cold gun, a cyclone tube and/or a vortex tube can be used for cooling the bristle bundles.

In order for the bristle bundles to be able to be introduced more easily into the bundle receptacles, the bundle receptacles of the bundle pocket can be impinged with negative pressure. The bristle bundles can then be suctioned into the bundle receptacles of the bundle pocket by negative pressure.

The thermal input for heating the bristle bundles can take place by way of thermally conducting convexities, preferably molded on an external side of the bundle pocket. The at least one heat exchanger element of the bundle pocket that has already been mentioned above can be used as thermally conducting convex moldings of the bundle pocket, for example.

In one embodiment of the method it is provided that for heating the bristle bundles situated within the bundle pocket a heated fluid, in particular air, is directed through flow ducts of the bundle pocket. For cooling the bristle bundles situated within the bundle pocket a cooled fluid, in particular air, can be directed through flow ducts of the bundle pocket.

In one embodiment of the method it is provided that a fluid, for example the previously mentioned fluid, in particular air, for incorporating the heat, upon heating the bristle bundles is released into the environment. It is however also possible that the fluid used for heating the bristle bundles is to be guided in a closed system, in particular in a recirculating air system or a closed-circuit system. This can reduce the energy requirement of the apparatus which is used for carrying out the method.

A thermal input for heating the bristle bundles can be monitored by a regulator unit or a controller.

In one embodiment of the method it is provided that even prior to the bristle bundles being introduced into the bundle pocket, a bundle pocket, for example the bundle pocket already previously mentioned, which is used for forming the bristle bundles, is heated to a basic heat above the ambient temperature.

The bristle bundles can furthermore be extracted from a bundle pocket, for example the bundle pocket already previously mentioned, for forming the bristle bundles, before said bristle bundles have reached their final cooling temperature. The cycle times in carrying out the method can be reduced on account thereof.

When carrying out the method, bristle bundles having bristle filaments from PE, PBT, PA6.10, PA6.12, PA10.10, PA4.10 and/or from a mixture and/or from a composite of said materials can be used.

The previously mentioned object is also achieved by a brush manufacturing machine which has at least some of the means and features described herein directed toward such a brush manufacturing machine. In order for the object to be achieved, a brush manufacturing machine which has at least one apparatus for forming bristle bundles according to one or more of the features described herein directed toward such an apparatus is in particular proposed.

The brush manufacturing machine can have a rotary indexing table for receiving and transporting bundle pockets that are populated with bristle bundles. The rotary indexing table preferably has four arms which are in each case disposed so as to be mutually offset by 90°. The brush manufacturing machine can moreover have an input station for inputting bundle pockets that are populated with bristle bundles, a bundle profiling station on which the apparatus for forming bristle bundles is preferably disposed, and/or a bundle fusing station at anchoring or fastening nodes of the bristle bundles can be generated by fusing the bristle bundles.

The brush manufacturing machine can moreover be equipped with a retrieving station for retrieving bundle pockets and/or at least one further processing station. All of the previously mentioned stations can be disposed on or so as to be distributed about the rotary indexing table.

Bundle pockets that are populated with bristle bundles can be transported in a cycled manner to the individual stations of the brush manufacturing machine, and bristle bundles situated therein can be machined at said stations with the aid of the rotary indexing table and the preferably four arms thereof.

The previously mentioned object is moreover also achieved by the use of an apparatus for forming bristle bundles in the manufacture of brushes, said apparatus having at least some of the means and features described herein directed toward such an apparatus.

The invention furthermore also relates to a brush having one or more of the features described herein directed toward a brush. In order for the object to be achieved, a brush having a bristle complement which comprises at least two bristle bundles is thus in particular proposed, wherein at least two of the bristle bundles are unified in a common bundle portion.

The brush can furthermore have at least one bristle bundle which is provided with at least one clearance.

The clearance in the at least one bristle bundle of the brush can have a closed cross section that is defined by bristle filaments of the bristle bundle. The clearance can be disposed in the at least one bristle bundle of the brush between a first closed bundle portion and a second closed bundle portion of the bristle bundle. The first closed bundle portion can be adjacent to a free end of the bristle bundle. The second closed bundle portion can be adjacent to an end of the bristle bundle that is proximal to the bristle carrier or proximal to the handle.

The clearance can be delimited by the first closed bundle portion, on the one hand, and by the second closed bundle portion of the bristle bundle, on the other hand. The clearance can thus be ultimately delimited in a defined and lateral manner by bristle filaments of the bristle bundle, said bristle filaments surrounding the clearance in a preferably closed ring. The clearance in the bristle bundle can thus also be referred to as a window or a cutout which is configured within the bristle bundle. The clearance can be laterally surrounded by a closed ring or frame from bristle filaments of the bristle bundle and be delimited on account thereof.

The first closed bundle portion can lie between the clearance and a free end of the bristle bundle. The second closed bundle portion of the bristle bundle can be disposed between the clearance and an end of the bristle bundle that is proximal to the bristle carrier or proximal to the handle.

A length of the first closed bundle portion and/or a length of the second closed bundle portion can in each case be at least 5% of an overall length of the bristle bundle when measured in the direction of longitudinal extent of the bristle bundle.

The at least one bristle bundle of the brush can be connected to a bristle carrier of the brush. The brush can furthermore have a handle which in one embodiment of the brush can be, in particular integrally, connected to the bristle carrier of the brush.

The at least one bristle bundle of the brush herein can be formed by an apparatus and/or by a method as have/has already been previously explained in detail with one or more of the features described herein directed toward such an apparatus, or to such a method, respectively.

The bristle complement of the brush can comprise at least one bristle bundle which has two cross sections which in terms of the longitudinal axis of said bristle bundle are axially spaced apart from one another and which differ from one another in terms of shape and/or size.

As has already been mentioned above, at least two bristle bundles of the bristle complement of the brush are according to the invention unified in a common bundle portion. This common bundle portion can be configured at the free ends of the bristle bundles that are unified with one another. The bristle bundles can have a portion which is adjacent to the common bundle portion and in which said bristle bundles are separated from one another, thus remaining so as to be identifiable as separate bristle bundles.

In one embodiment of the brush, the bristle complement can have a helical, conical, frustoconical and/or chalice-shaped bristle bundle.

The bristle bundles can have bristle filaments which are composed of PE, PBT, PA6.10, PA6.12, PA10.10, PA4.10 or of a mixture, and/or of a composite of said materials.

The invention furthermore relates to a computer program which comprises commands which have the effect that the apparatus having one or more of the features described herein directed toward the apparatus and/or the brush manufacturing machine having one or more of the features described herein directed toward a brush manufacturing machine carry/carries out the method having one or more of the features described herein directed toward a method.

The invention furthermore relates to a computer-readable medium on which this computer program is stored. The computer-readable medium can be a data carrier which is made available to the final user. The computer-readable medium can also be a data storage in a cloud. It is thus possible for the computer program in the cloud to be kept up to date at all times, to be adapted when required, and to be read from there. The computer-readable medium can thus be cloud-based and/or be a data storage which is provided in the cloud and/or is accessible by way of a cloud.

The apparatus and/or the brush manufacturing machine can have a preferably wireless data interface. The apparatus and/or the brush manufacturing machine by way of said data interface, preferably wireless data interface, can establish a data connection to a computer-readable medium on which the computer program is stored, so as to read the computer program. It is subsequently possible for the method, as previously described, to be preferably automatically and/or autonomously carried out on the brush manufacturing machine and/or on the apparatus.

It is particularly advantageous for the brush manufacturing machine and/or the apparatus to be specified for preferably automatically or autonomously establishing a data connection to a computer-readable medium, in particular to a cloud-based data storage which then functions as a computer-readable. The latter with the objective of reading the computer program, which is kept ready there and, on account thereof, of rendering the brush manufacturing machine and/or the apparatus capable of carrying out the method according to the invention. The communication with the cloud and the cloud-based data storage can take place by way of a network, for example by way of the internet.

BRIEF DESCRIPTION OF THE DRAWINGS

The invention will now be described in more detail by an exemplary embodiment but is not limited to this exemplary embodiment. Further exemplary embodiments are derived by combining the features of individual or a plurality of claims with one another and/or in combination with individual or a plurality of features of the exemplary embodiment. In the figures, to some extent in a highly schematic illustration:

DETAILED DESCRIPTION

Figure 1:
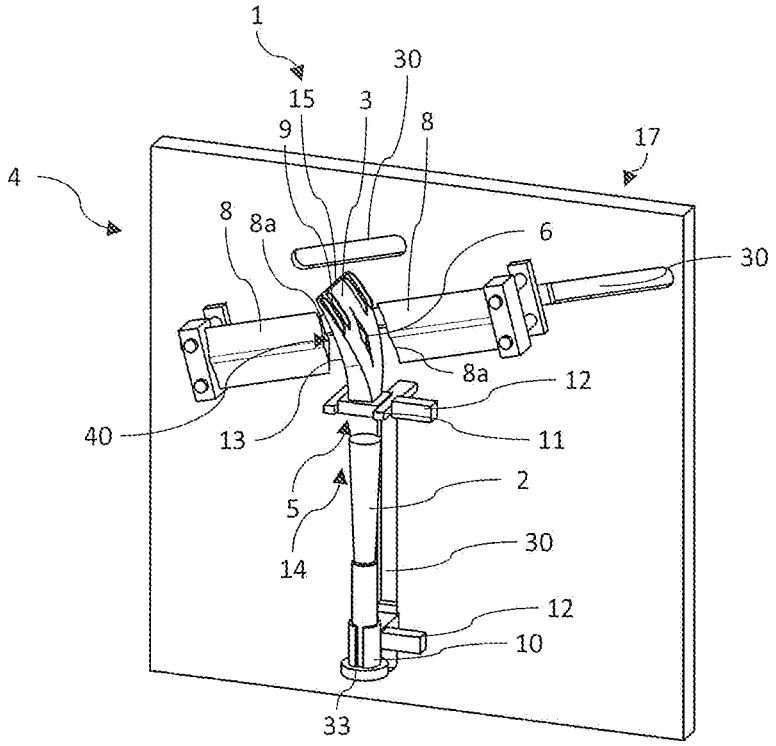
FIGS. 1 to 12: show highly schematic illustrations of an apparatus according to the invention for forming bristle bundles, for visualizing the forming procedure that is able to be carried out with the aid of the apparatus.

In the description of the figures hereunder, functionally identical or equivalent elements are provided with the same reference signs even in the case of variations in terms of the design or the shaping.

FIGS. 1 to 17 and 19 show at least parts of different embodiments of an apparatus for forming bristle bundles 2, said apparatus in its entirety being referred to by the reference 1. The apparatus 1 comprises at least one bundle pocket 3. The bundle pocket 3 serves for receiving at least one bristle bundle 2. For receiving a bristle bundle 2, the bundle pocket 3 has at least one bundle receptacle 40. The apparatus 1 furthermore comprises a heating apparatus 4 which by the area marked by zigzag hatching is illustrated in a highly schematic manner in FIG. 14. The heating apparatus 4 serves for heating the at least one bundle pocket 3 and a bristle bundle 2 that is positioned in the bundle pocket 3.

A bristle bundle 2 can be introduced into the bundle pocket 3 through an introduction opening 5 of the bundle pocket 3. The bundle pocket 3 of the apparatus 1 illustrated in FIGS. 1 to 12 has two lateral piercings 6. A displacement means 7 of the apparatus 1, for profiling a bristle bundle 2 that has been introduced into the bundle pocket 3, can be introduced into the bundle pocket 3 through the lateral piercings 6. FIGS. 6 to 9 highlight the use of the displacement means 7.

Figure 2:
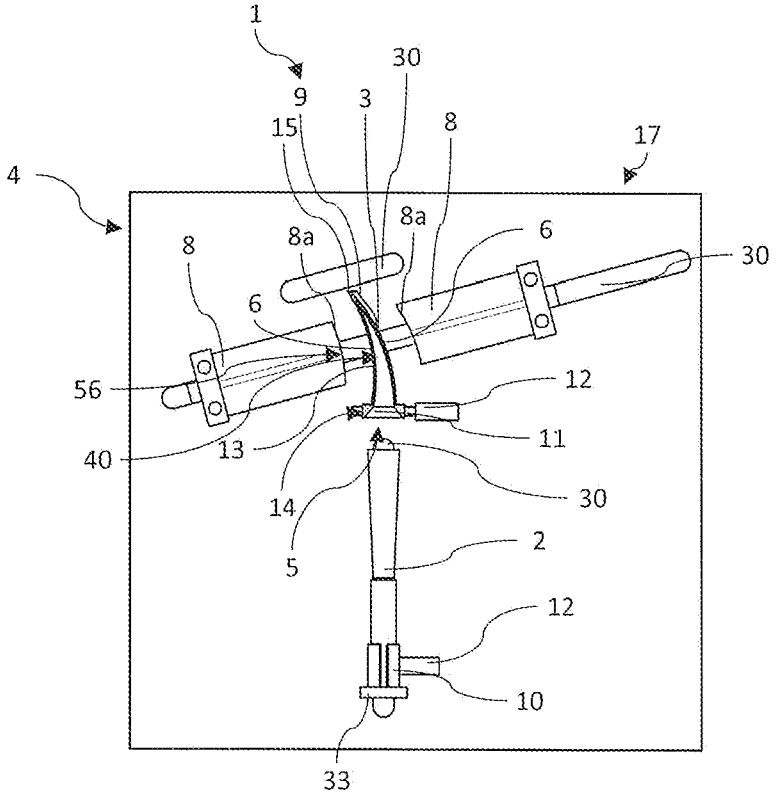
Figure 3:
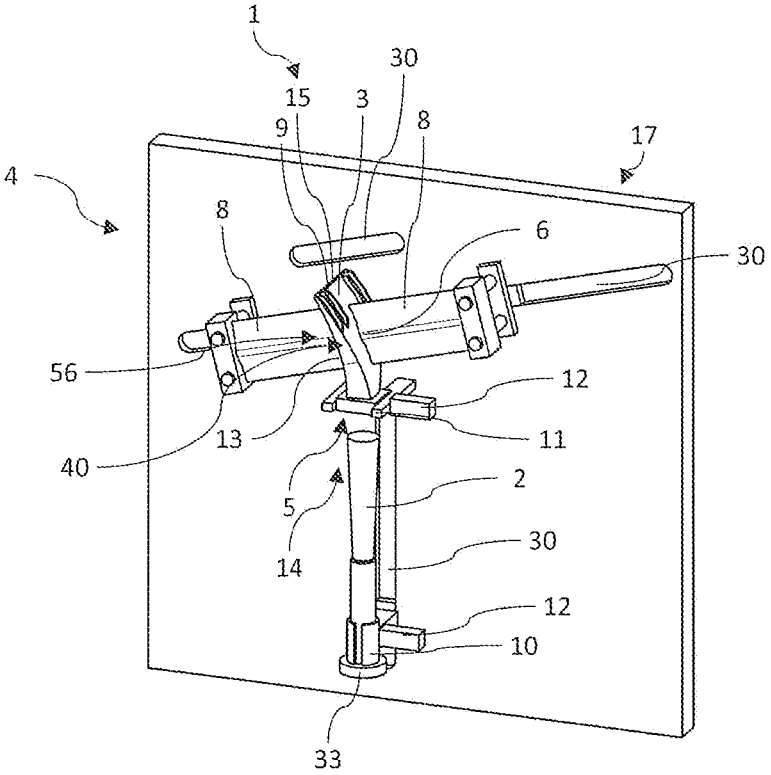
Figure 13:
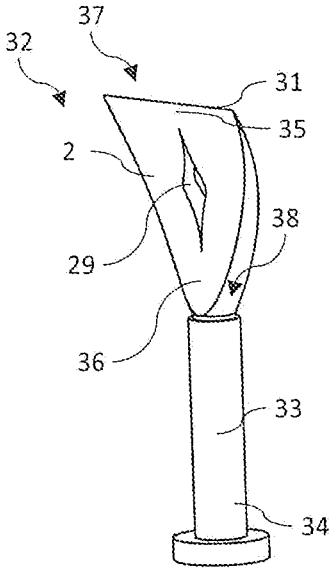
FIG. 13: shows a perspective illustration of a brush having a bristle bundle which has been formed with the aid of the apparatus illustrated in FIGS. 1 to 12.

The apparatus 1, under the effect of heat which by the heating apparatus 4 is dissipated to the bundle pocket 2 and the bristle bundle 2 disposed therein, by way of the bundle pocket 3 is specified for forming a bristle bundle 2 that has been introduced into the bundle pocket 3, proceeding from a non-deformed initial shape to a deformed, desired target shape, which can be seen in FIGS. 1 to 3. The result of the forming procedure is a bristle bundle 2 as is shown in FIG. 13, for example.

The two piercings 6 of the bundle pocket 3 lie opposite one another such that the displacement means 7 for generating a clearance 29 within the bristle bundle 2 can be pushed through the bundle pocket 3 (see FIGS. 6 to 9). The bristle bundle 2 herein is correspondingly profiled or deformed, and the clearance 29 which can be particularly readily seen in FIG. 13 is generated.

In order to prevent bristle filaments from exiting the bristle bundle 2 from the initially still open piercings 6 when the bristle bundle 2 is introduced into the bundle pocket 3, the apparatus 1 has two closure means 8. The two lateral piercings 6 of the bundle pocket 3 can be temporarily closed with the aid of the two closure means 8.

FIGS. 1 and 2 show the two closure means 8 in the initial position thereof. A comparison of FIGS. 1, 2 and 3 highlights how the two closure means 8, proceeding from the initial position thereof, are moved to the closing position thereof on the bundle pocket 3, so as to temporarily close the two lateral piercings 6. The two closure means 8 are configured as profiled pins which have in each case an end face 8*a*. The end faces 8*a* are adapted to the cross section of the piercings 6 of the bundle pocket 3 such that said end faces 8*a* in the closure position of the closure means 8 on the bundle pocket 3, conjointly with the internal faces of the bundle pocket 3, forms a surface that is almost free of any offset. This facilitates the introduction of the bristle bundle 2 into the bundle pocket 3.

Figure 4:
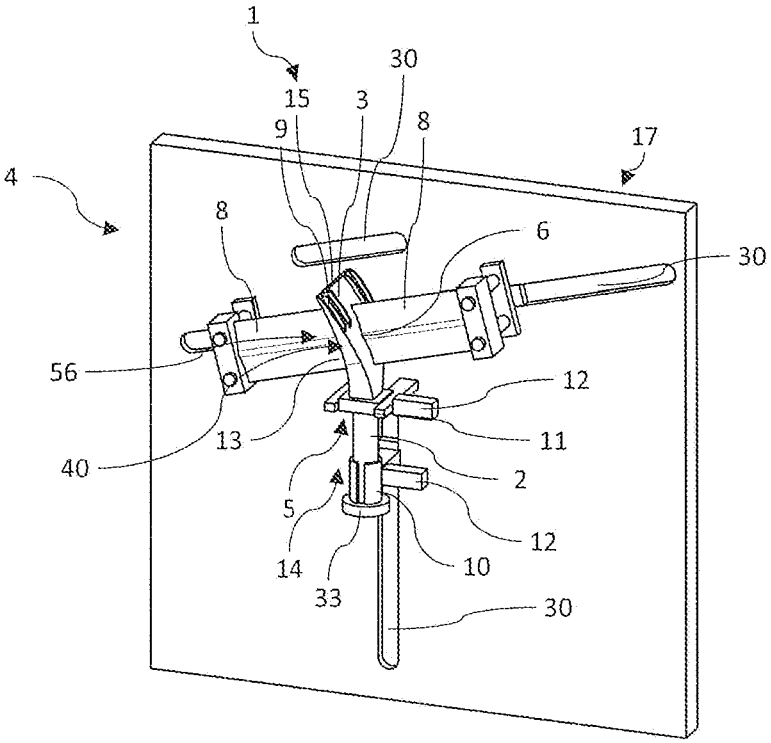

As soon as the two closure means 8 have assumed the closing position thereof, the bristle bundle 2 that has been kept ready can be introduced through the introduction opening 5 into the bundle pocket 3. This is illustrated in FIG. 4.

The bundle pocket 3 illustrated in the figures is with a plurality of heat exchanger elements 9. The heat exchanger elements 9 facilitate a take-up of heat during the heating phase and a dissipation of heat during a cooling phase. The heat exchanger elements 9 are configured as cooling/heating ribs. The heat exchanger elements function as thermally conducting convex moldings on the external sides of the illustrated bundle pocket 3.

The apparatus 1 moreover has a bundle gripper 10 and a bundle pocket gripper 11. The bundle gripper 10 as well as the bundle pocket gripper 11 are movable between an initial position and a machining position. The bundle gripper 10 serves for moving a bristle bundle 2, proceeding from the initial position (cf. FIGS. 1 to 3), to a machining position and for introducing the bristle bundle 2 into the bundle pocket 3 herein.

The bundle pocket gripper 11 can be used for holding the bundle pocket 3 and for transferring the latter when required. The bundle gripper 10 as well as the bundle pocket gripper 11 is in each case assigned a vibrator 12. The vibrators 12 are used for setting in vibration the bundle pocket 3, on the one hand, and a bristle bundle 2, on the other hand, when the bristle bundle 2 is being introduced into the bundle pocket 3. This facilitates the bristle bundle 2 sliding into the bundle pocket 3.

FIG. 2 shows a sectional illustration of the bundle pocket 3. The sectional illustration highlights that the bundle pocket 3 has a wall 13 with an approximately constant wall thickness. An inner contour of the bundle pocket 3 is adapted to an outer contour of the bundle pocket 3.

The sectional illustration of the bundle pocket 3 according to FIG. 2 furthermore shows that the introduction opening 5 of the bundle pocket 3 is provided with an introduction funnel 14. The introduction funnel 14 facilitates an introduction of bristle bundles 2 into the interior of the bundle pocket 3.

The bundle pocket 3 of the apparatus 1 shown in the figures is present as a materially homogenous, monolithic unit which is 3D-printed. Bundle pockets 3 having comparatively complex pocket geometries can be generated with the aid of a 3D-printing method.

Figure 11:
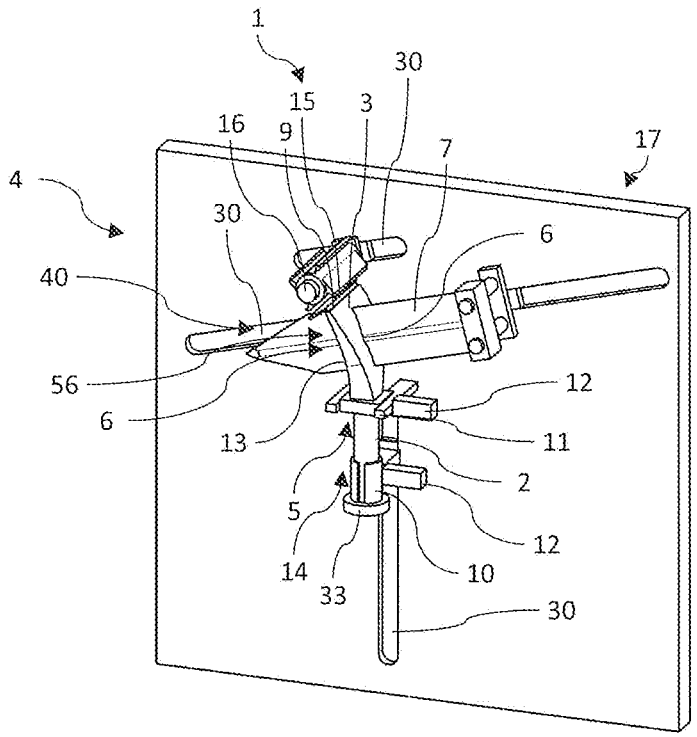
Figure 12:
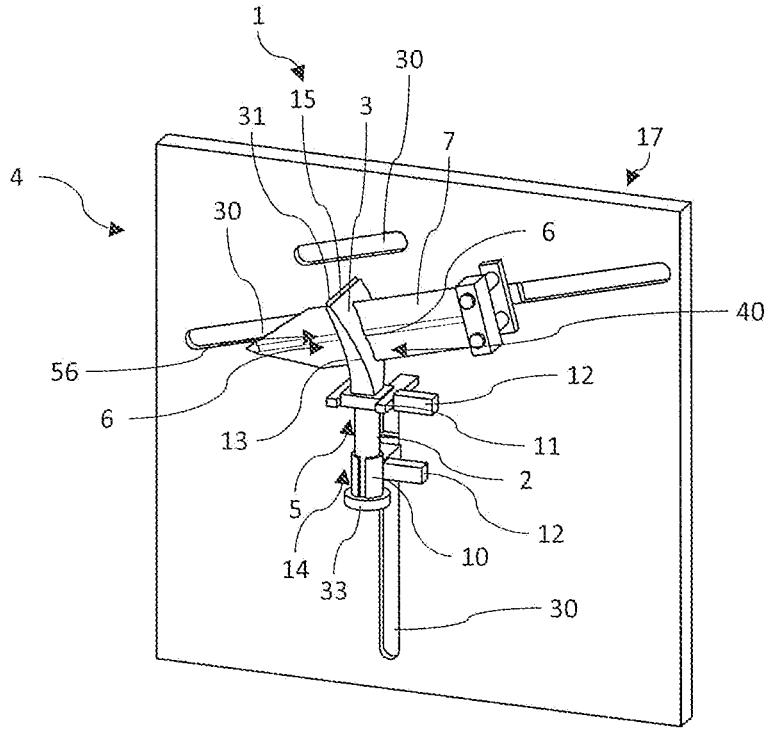

The embodiment of a bundle pocket 3 shown in FIGS. 11 and 12, on the side thereof that lies opposite the introduction opening 5 into the bundle pocket 3, has an exit opening 15. The free ends 31 of bristle filaments of a bristle bundle 2 that has been introduced into the bundle pocket 3 can protrude from this exit opening 15 (see FIG. 12). While the bristle bundle 2 in this instance is disposed within the bundle pocket 3, the free ends of the bristle filaments are in this way accessible for further machining.

For the machining of the bristle filaments of a bristle bundle 2 situated in the bundle pocket 3, the apparatus 1 is equipped with at least one machining means 16. The machining means 16 which is illustrated in a highly schematic manner in FIG. 11 is a cutter 16 by way of which the bristle filaments can be trimmed at the free ends 31 thereof.

Figure 9:
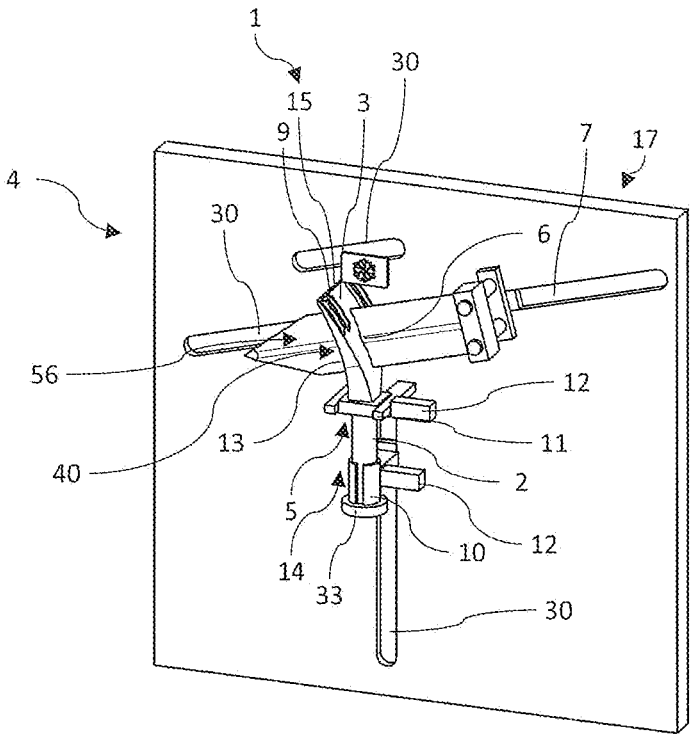
Figure 10:
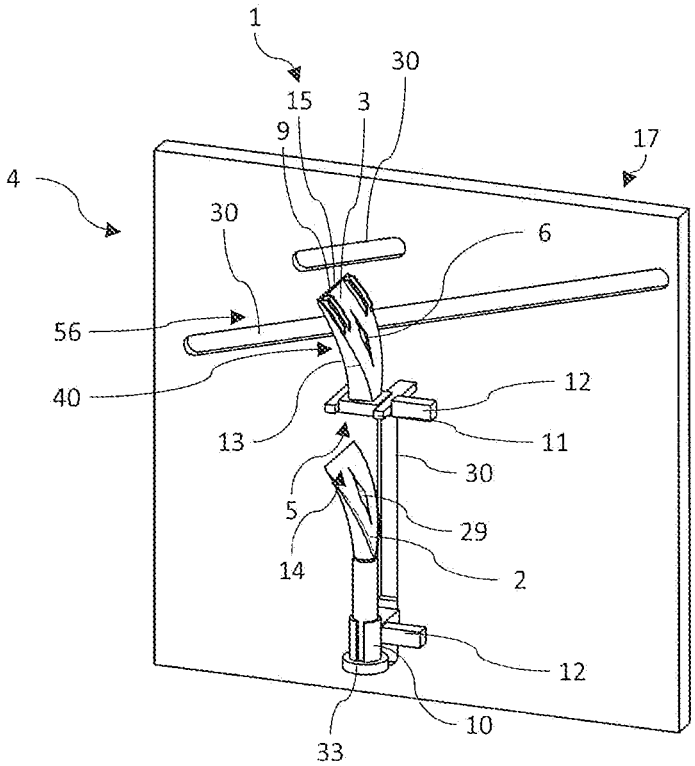

The pictogram shown in FIG. 9 indicates that the apparatus 1, apart from the heating apparatus 4 thereof, also has a cooling apparatus 17. The bundle pocket 3 and the bristle bundle 2 situated therein can be actively cooled with the aid of the cooling apparatus 17. The latter, upon successful forming, has the objective of cooling the bristle bundle 2 in an ideally rapid manner to a temperature required for the further machining of said bristle bundle 2.

The apparatus 1 furthermore has a plurality of guides 30 which predefine adjustment paths for the displacement means 7, the closure means 8, the bundle body 10, and the machining means 16. In the exemplary embodiment of the apparatus 1 shown in the Figures, the guides 30 are illustrated in a highly simplified manner as guide slots 30.

Figure 5:
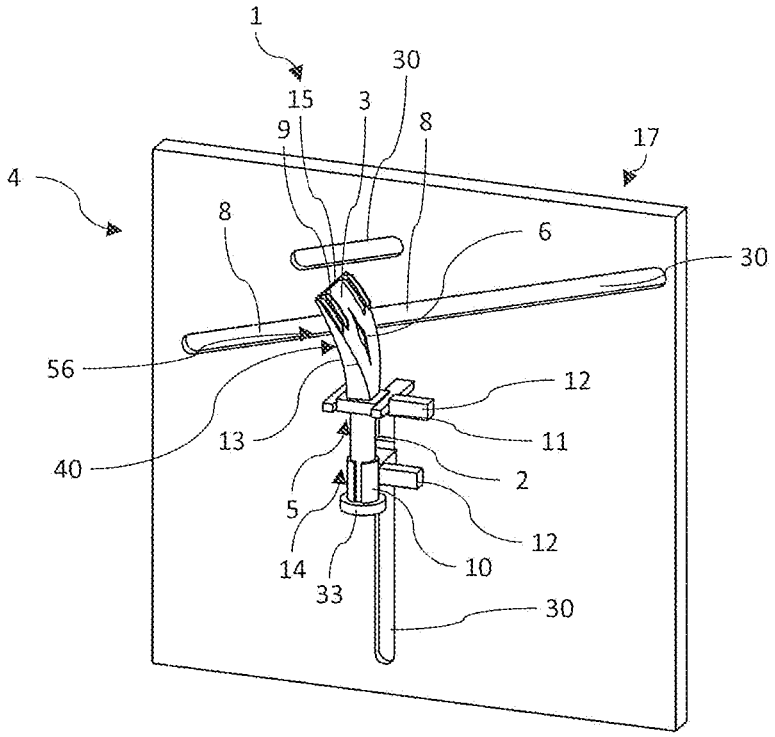
Figure 6:
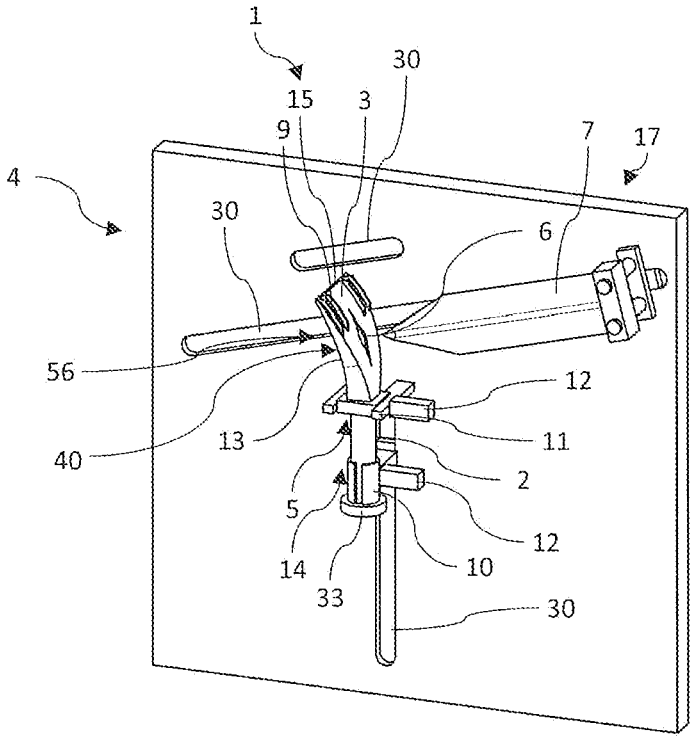
Figure 7:
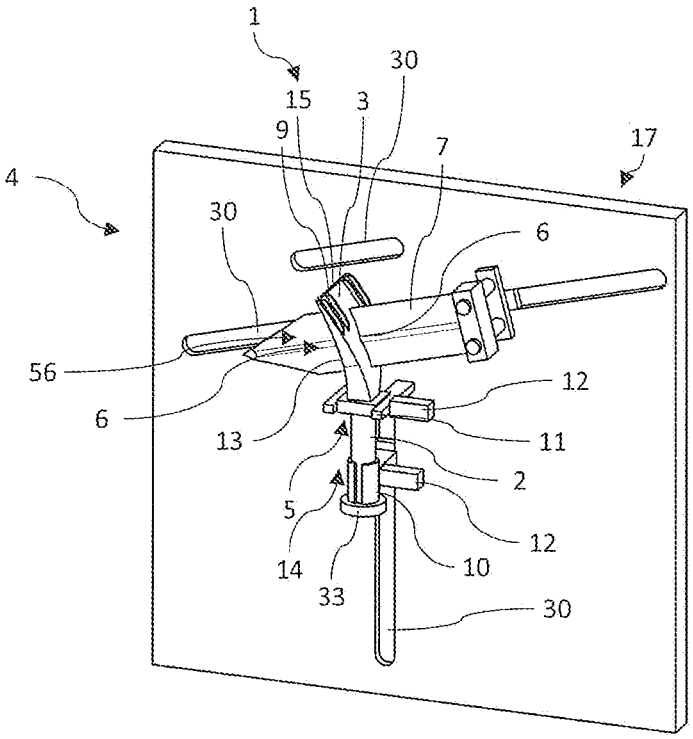

FIG. 5 now shows the apparatus 1 once the bristle bundle 2 has been introduced into the bundle pocket 3. The displacement means 7, here a profiled displacement pin, can be seen in FIG. 6. The displacement means 7 is initially introduced into the bundle pocket 3 through the first piercing 6. Bristle filaments of the bristle bundle 2 situated in the bundle pocket 3 are laterally displaced herein. The displacement means 7 is further pushed into the bundle pocket 3 until said displacement means 7 exits from the bundle pocket 3 through the second piercing 6 (see FIG. 7).

Figure 8:
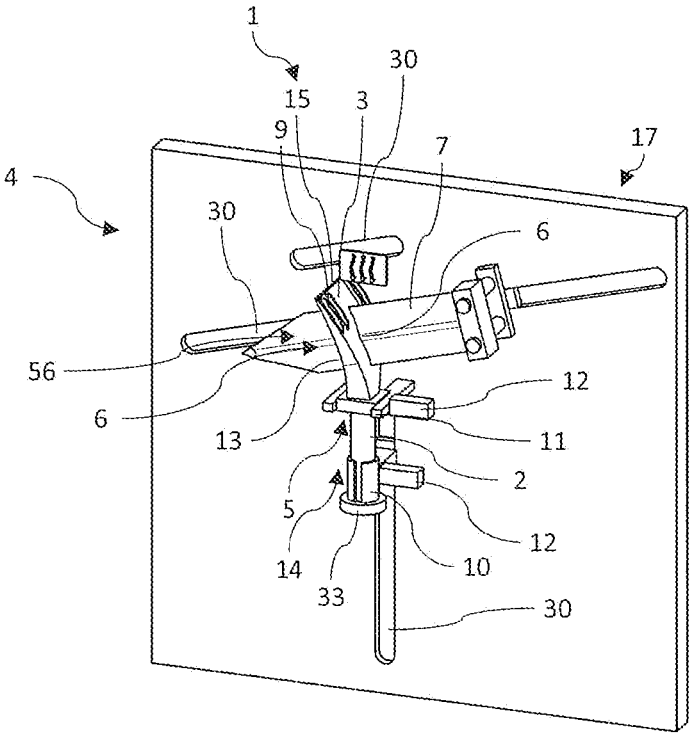

The pictogram shown in FIG. 8 highlights that the heating apparatus 4 is subsequently activated so as to heat the bundle pocket 3 and the bristle bundle 2 that in the desired target shape is held within the bundle pocket 3, so as to set the target shape of the bristle bundle 2 as predefined by the bundle pocket 3 and the displacement means 7.

As soon as the bristle bundle 2 has been heated for a sufficient time, the heating apparatus 4 can be deactivated and the cooling apparatus 17 of the apparatus 1 can be switched on so as to actively cool the bundle pocket 3 and the bristle bundle 2 situated therein (see FIG. 9).

The displacement means 7 is subsequently retracted from the bundle pocket 3, and the deformed bristle bundle 2 is removed from the bundle pocket 3. To this end, the bundle body 10 is moved back along the guide 30 thereof to the initial position thereof (see FIG. 10). The supporting action of the displacement means 7 in the clearance 29 generated in the bristle bundle 2 can be clearly seen herein.

The apparatus 1 is thus specified for forming the bristle bundle 2, proceeding from a non-deformed initial shape which can be seen in FIGS. 1 to 3, for example, to a desired target shape. Bristle filaments of the bristle bundle 2 for generating the clearance 29 herein are in particular laterally displaced with the aid of the displacement means 7. The bristle bundle 2 is subsequently heated so as to set the target shape of the bristle bundle 2 and thus the clearance 29 generated in the bristle bundle 2.

FIG. 13 finally shows a brush 32 of which the single bristle bundle 2 has been shaped using the apparatus 1 illustrated in FIGS. 1 to 12. The clearance 29 which has been generated within the bristle bundle 2 when forming the bristle bundle 2 can be clearly seen. The bristle bundle 2 is connected to a bristle carrier 33 of the brush 32, said bristle carrier 33 simultaneously functioning as the handle 34 of the brush 32. The brush 32 can also be referred to as a paintbrush since the latter has only one bristle bundle 2.

FIG. 13 furthermore shows that the bristle bundle 2 has a first closed bundle portion 35 and a second closed bundle portion 36, the clearance 29 configured in the bristle bundle 2 being disposed therebetween. The first closed bundle portion 35 of the bristle bundle 2 lies between the clearance 29 and a free end 37 of the bristle bundle 2 on which the free ends 31 of the bristle filaments of the bristle bundle 2 are disposed. The second closed bundle portion 36 of the bristle bundle 2 lies between the clearance 29 and an end 38 of the bristle bundle 2 that is proximal to the bristle carrier or proximal to the handle.

The first closed bundle portion 35 and the second closed bundle portion 36 of the bristle bundle 2 have in each case a length which corresponds to at least 5% of an overall length of the bristle bundle 2. The overall length of the bristle bundle 2 can be the length of the bristle bundle 2 that can be measured between the bristle carrier 33 and the free end 37 of the bristle bundle 2. The clearance 29 thus forms a cutout or a window within the bristle bundle 2 that is laterally surrounded and thus delimited by a ring or a frame from bristle filaments of the bristle bundle 2.

Figure 15:
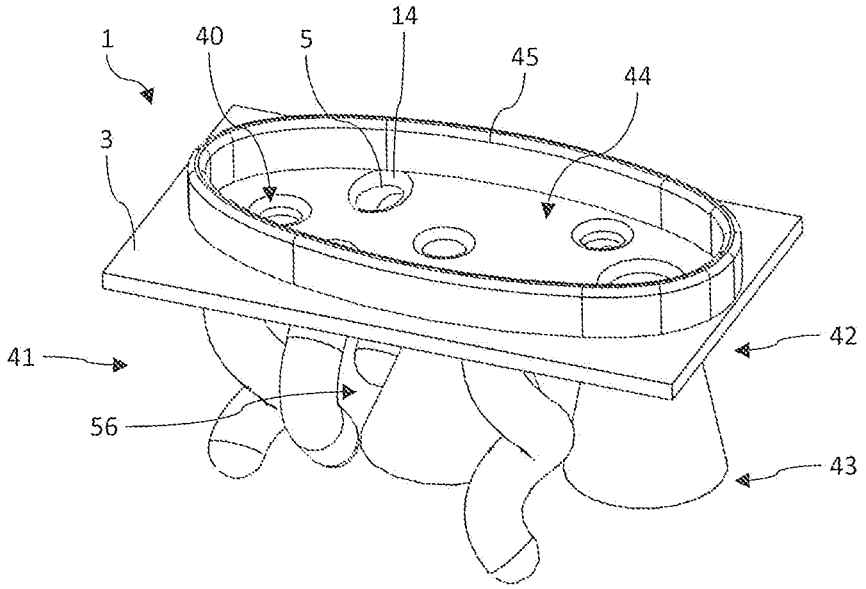
FIG. 15: shows a perspective view of another embodiment of a bundle pocket of an apparatus for forming bristle bundles, wherein the bundle pocket has a number of dissimilarly shaped bundle receptacles that corresponds to the number of bristle bundles in a bristle complement of a brush.
Figure 16:
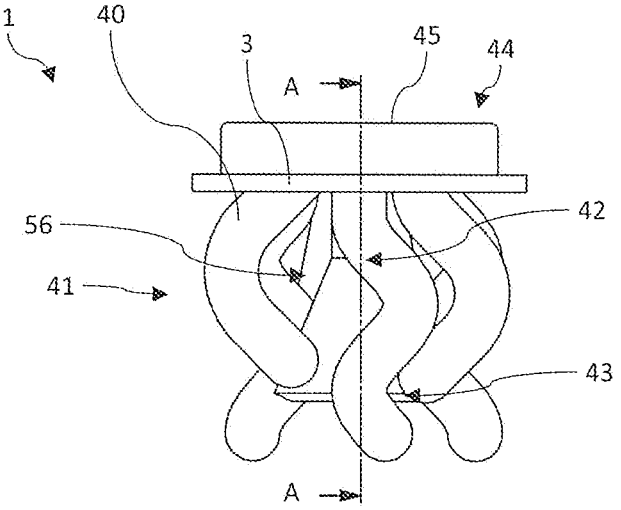
FIG. 16: shows an end view of the bundle pocket illustrated in FIG. 15.
Figure 17:
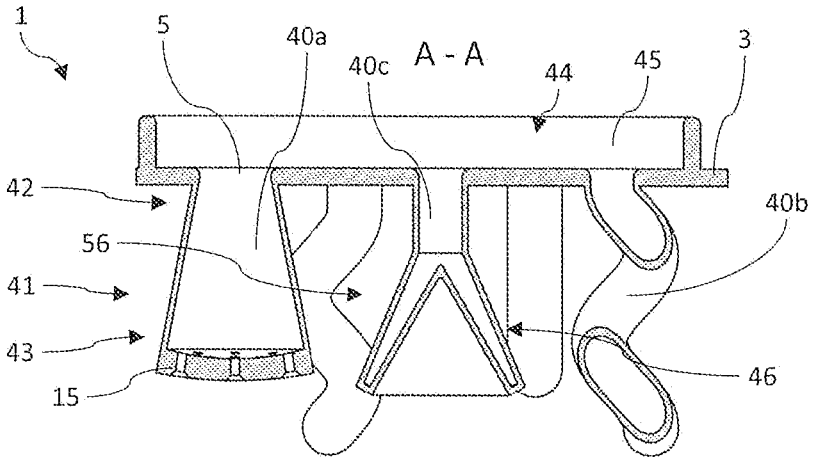
FIG. 17: shows a lateral view of the bundle pocket depicted in FIGS. 15 and 16, sectioned along the section line A-A from FIG. 16.
Figure 18:
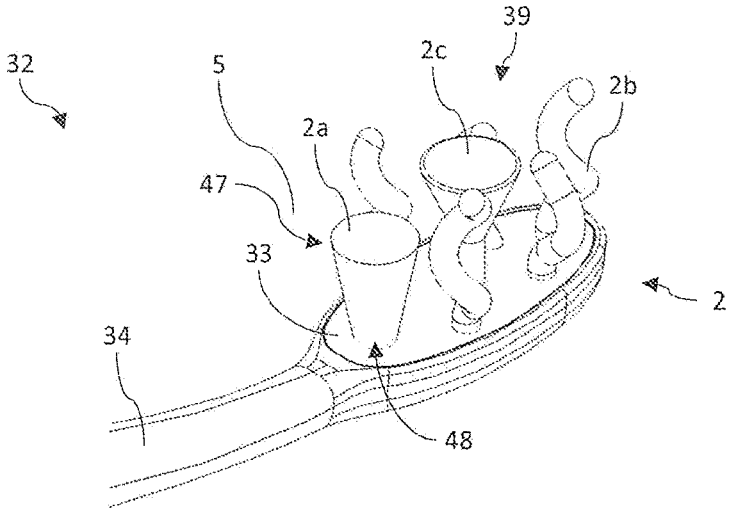
FIG. 18: shows a perspective view of a toothbrush of which the bristle bundles have been formed using the bundle pocket illustrated in FIGS. 15 to 17.
Figure 19:
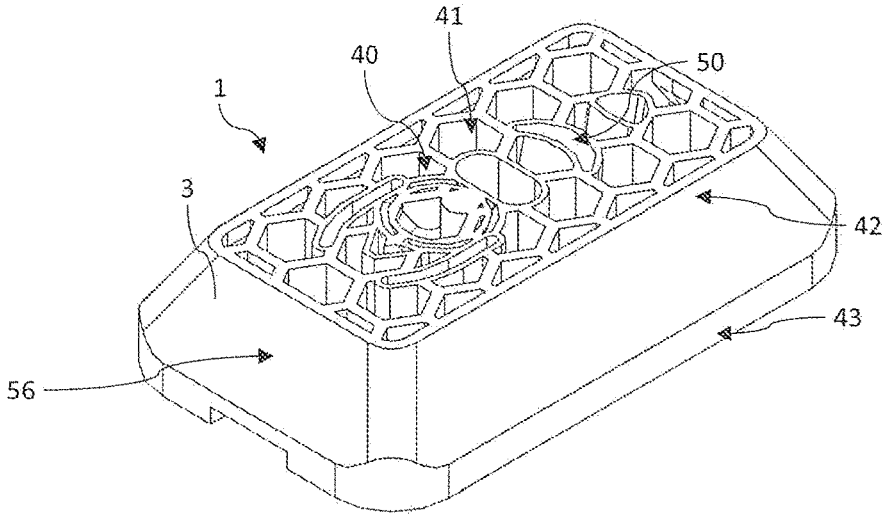
FIG. 19: shows a perspective view from below of a further embodiment of a bundle pocket.
Figure 20:
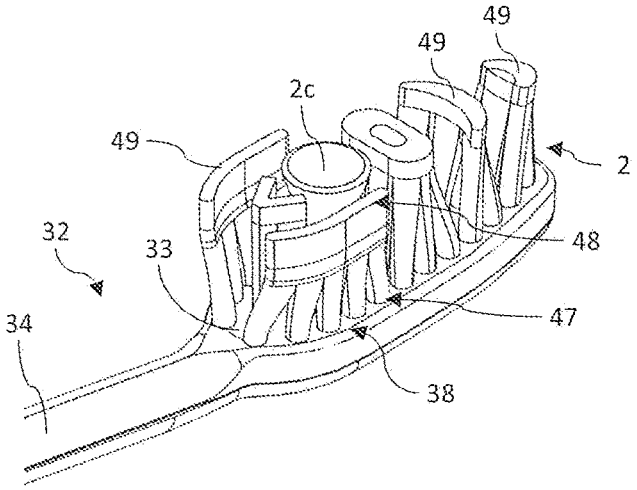
FIG. 20: shows a perspective view of a brush of which the bristle bundle has been formed by the bundle pocket illustrated in FIG. 19.

FIGS. 15 to 17 and 19 show bundle pockets 3 of an apparatus 1 which are suitable for forming bristle bundles 2 of an entire bristle complement 39 of a brush 32. A brush 32, specifically a toothbrush, the bristle bundle 2 thereof having been formed using the bundle pocket 3 shown in FIGS. 15 to 17, is illustrated in FIG. 18. A brush 32, specifically a toothbrush, the bristle bundle 2 thereof having been formed using the bundle pocket 3 shown in FIG. 19, is illustrated in FIG. 20.

These bundle pockets 3 have a plurality of bundle receptacles 40 into which the bristle bundles 2 of the bristle complement 39 of the brush 32 are introduced so as to form the bristle bundles 2 in order for the brush 32 to be individualized.

The apparatus 1 with which the bundle pockets 3 shown in FIGS. 15 to 17 and 19 can be used likewise has a heating apparatus 4. It is to be mentioned at this point that the bundle pocket 3 shown in FIGS. 15 to 17 and 19 can be used on an apparatus 1 as is depicted in FIGS. 1 to 12.

The bundle receptacles 40 of these bundle pockets 3 are configured so as to be bundle-forming and, under the effect of heat dissipated by the heating apparatus 4, specified for forming the bristle bundles 2 of the bristle complement 39 that have been incorporated into the bundle receptacles 40 in comparison to the shape of said bristle bundles prior to being introduced into the bundle receptacles 40. The latter with the objective of setting the shaping of the bristle bundles 2 that have been incorporated into the bundle receptacles 40 as predefined by the bundle receptacles 40.

The bundle pocket 3 which is in each case shown in FIGS. 15 to 17 and 19 has a group 41 of bundle receptacles 40. The bundle receptacles 40 of the bundle pocket 3 in the one group 41 are disposed like the bristle bundles 2 in the bristle complement 39 of the brush 32 shown in FIG. 19. There are as many bundle receptacles 40 provided in the group 41 as there are bristle bundles 2 in the bristle complement 39 of the brush 32.

At least two of the bundle receptacles 40 of the bundle pockets 3 in terms of a longitudinal axis of the respective bundle receptacles 40 have in each case two cross sections 42 and 43 which are axially spaced apart from one another and differ from one another in terms of shape and/or size.

The bundle pocket 3 shown in FIGS. 15 to 17 on the rear side has a bristle carrier receptacle 44. A bristle carrier 33 of a brush 32, on which the bristle complement 39 of the brush 32 is configured, can be positioned in this bristle carrier receptacle 44, in order for the bristle bundle 2 of the bristle complement 39 to be formed.

According to FIG. 17, a bundle receptacle 40*c* of the bundle pocket 3 has a bundle receptacle portion 46 which is defined by envelope faces of two cones or truncated cones. The longitudinal central axes of the cones or truncated cones, respectively, are congruent but the cones or truncated cones respectively, have different radii. A chalice-shaped bundle receptacle 40*c* is thus created on the bundle pocket 3, said bundle receptacle 40*c*, proceeding from the introduction portion 44 thereof, fanning out in a chalice-shaped manner.

The bundle pocket 3 shown in FIGS. 15 to 17 moreover has five bundle receptacles 40*b*, the longitudinal central axes thereof being helical. The result of the forming of bristle bundles 2 with the aid of these helical bristle receptacles 40 are correspondingly helical bristle bundles 2*b* as can be seen on the bristle carrier 33 of the brush 32 shown in FIG. 18. The last of the total of seven bundle receptacles 40 of the bundle pocket 3 that is illustrated in FIGS. 15 to 17 is a frustoconical bundle receptacle 40*a* by way of which frustoconical bristle bundles 2*a* can be formed.

The brush 32 shown in FIG. 18 is a toothbrush and has a total of seven individual bristle bundles 2 of which five bristle bundles 2*b* have a longitudinal axis which winds along a helical line, said five bristle bundles 2*b* thus being able to be referred to as helical bristle bundles 2*b*. One of the seven bristle bundles 2 is a conical bristle bundle 2*a*. A further bristle bundle 2 of the bristle complement 39 is a chalice-shaped bristle bundle 2*c*. When forming the chalice-shaped bristle bundle 2*c*, the latter, proceeding from the non-deformed initial shape thereof, is spread open so as to form the chalice shape shown in the figures.

In the bundle pocket 3 depicted in FIG. 19 a plurality of bundle receptacles 40 which conjointly receive two or more bristle bundles 2 and unify said bristle bundles 2 in a common bundle receptacle portion 50. These bundle receptacles 40 gather at least two separate bristle bundles 2 and unify the latter in the region of the free ends thereof. The bristle bundles 2, at the ends 38 thereof proximal to the bristle carrier, are also identifiable as separate bristle bundles which are still separated from one another in the completely formed bristle complement 39.

In the use of the bundle pocket 3 shown in FIGS. 15 to 17 and 19, at least one of the bristle bundles 2 of the bristle complement 39 of a brush 32 is formed in such a manner that said bristle bundle 2 in terms of the longitudinal axis thereof has two bundle cross sections 47 and 48 which are axially spaced apart from one another. These two bundle cross sections 47 and 48 differ from one another in terms of shape and/or size.

In the use of the bundle pocket 3 shown in FIG. 19, at least two bristle bundles 2 from the bristle complement 39 of a brush 32 in the region of the free ends thereof are unified in a common bundle portion 49. In the brush 32 shown in FIG. 20, a plurality of groups of, for example, four or else five individual bristle bundles 2 are gathered so as to form a common bundle portion 49 and are unified therein.

The bundle receptacles 40 of the bundle pocket 3 illustrated in FIGS. 15 to 18 at the introduction openings 5 thereof for the bristle bundles 2 are equipped with introduction funnels 14. These introduction funnels 14 facilitate a gentle introduction of the bristle bundles 2 into the bundle receptacles 40 of the bundle pocket 3.

The sectional illustration of the bundle pocket 3 according to FIG. 17 highlights in particular that the frustoconical bundle receptacle 40*a* is provided with exit openings 15 from which free ends of bristle filaments can exit and, on account thereof, are accessible for further machining.

Figure 14:
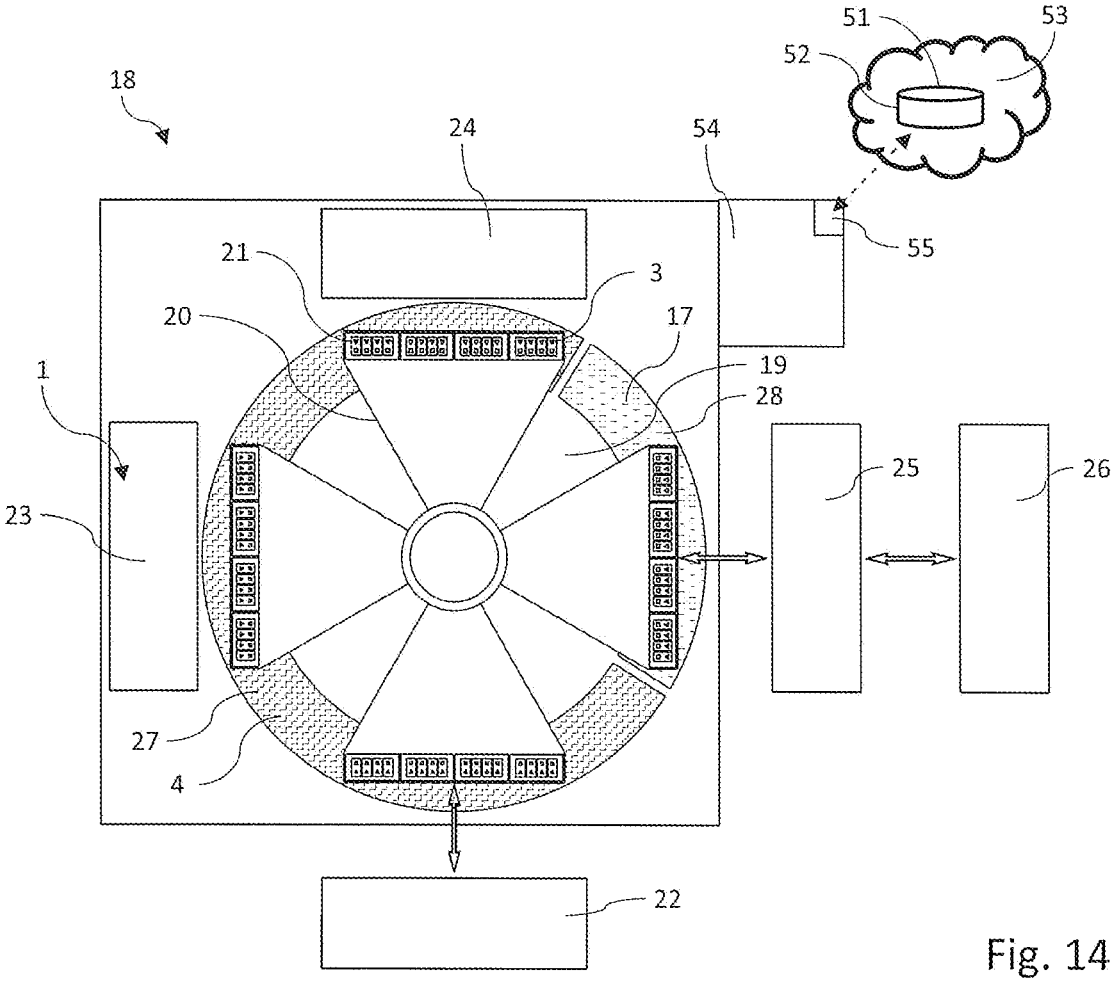
FIG. 14: shows a highly schematic plan view of a brush manufacturing machine according to the invention which at one of the stations thereof has an apparatus for forming bristle bundles.

The apparatuses 1 for forming bristle bundles 2, the former shown at least in component parts in FIGS. 1 to 12 and 15 to 17 and 19, can be used on a brush manufacturing machine 18 as is illustrated in a highly schematic manner in FIG. 14. The brush manufacturing machine 18 shown in FIG. 14 comprises a rotary indexing table 19 having a total of four arms 20 which are in each case disposed so as to be mutually offset by 90°.

Each of the arms 20 is specified for receiving a plurality of cassettes 21 which in turn can receive a plurality of bundle pockets 3. The arms 20 are moved in a cycled manner from one station to another station of the brush manufacturing machine 18. The cassettes 21 and/or individual bundle pockets 3 can be transported between the arms 21 and the individual stations of the brush manufacturing machine 18 with the aid of handling apparatuses which are not illustrated in more detail.

As has already been mentioned above, the brush manufacturing machine 18 has different stations at which bristle bundles 2 can be machined or handled. One of the stations of the brush manufacturing machine 18 is an input station 22. Bundle pockets 3 that are populated with bristle bundles 2 are supplied to the arms 20 of the rotary indexing table 19 with the aid of the input station 22. It is to be expressly stated that the bundle pockets 3 which are illustrated in FIGS. 1 to 12, as well as the bundle pockets 3 which are illustrated in FIGS. 15 to 17 as well as 19, can be used on the brush manufacturing machine 18.

The brush manufacturing machine 18, in a manner offset by 90° in relation to the input station 22, has a bundle profiling station 23. The apparatus 1 for forming bristle bundles 2, shown in FIGS. 1 to 12, is disposed on the bundle profiling station 23 of the brush manufacturing machine 18.

The brush manufacturing machine 18, in a manner offset by 90° in relation to the bundle profiling station 23, has a bundle fusing station 24. The formed bristle bundles 2 are fused on one side in the bundle fusing station 24 so as to generate fastening nodes. The bristle bundles 2 can later be fastened to a bristle carrier of a brush with the aid of the fastening nodes.

A retrieving station 25 of the brush manufacturing machine 18, in a manner offset by 90° is disposed in relation to the bundle fusing station 24. With the aid of the retrieving station 25, machined bristle bundles 2 can be supplied to a further processing station 26 of the brush manufacturing machine that is disposed downstream of the retrieving station 25.

FIG. 14 shows a heating plate 27 of the heating apparatus 4, said heating plate 27 having the shape of an annular segment and being highlighted with a zigzag hatching. The annular segment-shaped heating plate 27 covers an angular range of 270°. This leads to the bundle pockets 3 being disposed on the arms 20, and bristle bundles 2 situated in said bundle pockets 3 with the aid of the heating apparatus 4, being able to be heated, or held at a temperature, respectively, during the transfer of said bristle bundles 2 from the input station 22 up to the bundle fusing station 24. The annular segment-shaped heating plate 27 of the heating apparatus 4 is adjoined by an annular segment-shaped cooling plate 28 of the already previously mentioned cooling apparatus 17 of the apparatus 1, said cooling plate 28 being smaller in comparison to the heating plate 27. The annular segment-shaped cooling plate 28 can cover an angular range of approximately 90°.

All of the apparatuses 1 shown can be provided with a bundle spreading apparatus which is specified for spreading the bristle bundles 2 prior to being introduced into the bundle receptacles 40 of the respective bundle pocket 3.

All of the apparatuses 1 shown can have a humidification apparatus for humidifying and/or steam-treating the bristle bundles 2.

Figure 21:
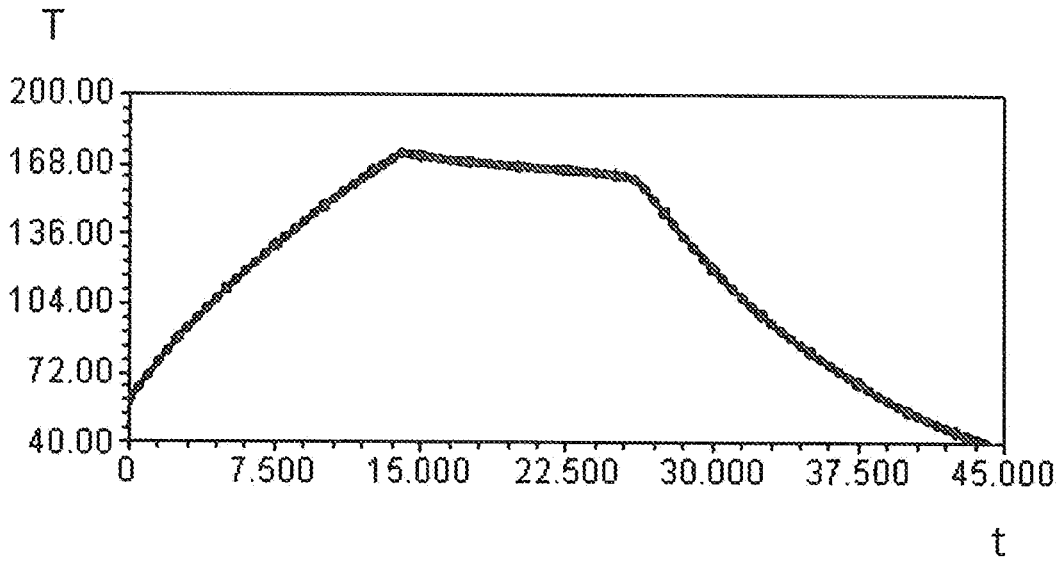
FIG. 21: shows a time/temperature diagram for visualizing a thermal profile curve according to which bristle bundles can be heated.

All of the apparatuses 1 shown can have a controller, for example the controller 54, which is specified for actuating the heating apparatus 4 such that the bristle bundles 2 in the bundle pocket 3 are heated according to defined thermal profile curves. FIG. 21 shows a time/temperature diagram having such a thermal profile curve. A temperature which on a contact face for bristle bundles 2 within a bundle pocket 3 is plotted over time in the diagram. Accordingly, the bristle bundles 2 are heated to a temperature of approx. 174° C. within approx. 13.5 seconds. The temperature of the contact face barely drops for a period of approximately 12 seconds, due to which the bristle bundles 2 are heated. The shaping imparted to the bristle bundles 2 by the bundle pocket 3 is set on account thereof. The contact face subsequently cools down to a temperature of 40° C. within approx. 18 seconds, and the thermal forming of the bristle bundles 2 is completed.

The bundle pockets 3 shown, due to the bundle receptacles 40 thereof, are specified for heating the bristle bundles 2 by thermal conduction by mechanical contacting, by induction and/or convection, preferably by a temperature-controlled fluid, and/or by thermal radiation.

The cooling apparatus 17 of the apparatus 1 in one embodiment is specified for cooling the bristle bundles 2 by a temperature-controlled fluid, in particular by compressed air and/or by nitrogen. To this end, the cooling apparatus 17 in this instance is equipped with a cold air gun, with a vortex tube, and/or with a cyclone tube, for example.

The bundle pockets 3 can be manufactured by eroding and/or by 3D-printing and/or by cutting, and/or from thin layers and/or sheets which are subsequently connected to one another.

The bundle receptacles 40 have a surface roughness of at most 6.3 μm. Furthermore, the bundle receptacles 40 in the push-fitting direction of the bristle bundles 2 are ground, specifically flow ground and polished. If required, said bristle bundles 2 can be provided with a surface coating so as to further reduce the surface roughness of said bristle bundles 2.

The apparatuses 1 illustrated can be equipped with a suction apparatus by way of which a negative pressure can be applied to the bundle pockets 3, in particular to the bundle receptacles 40, so as to facilitate an introduction of the bristle bundles 2. The bundle receptacles 40 of the bundle pockets 3 herein are impinged with negative pressure, due to which the bristle bundles 2 are suctioned into bundle receptacles 40 by negative pressure.

The bundle pockets 3 can be laterally perforated and/or have at least one flow duct 56 so as to accelerate an exchange of heat by way of the bundle pockets 3. A heated or else a cooled fluid can be directed through the flow duct 56 so as to temperature-control the respective bundle pocket 3 and bristle bundles 2 situated therein. Furthermore, at least part of the heating apparatus 4 can be integrated in the bundle pockets 3 shown.

When heated fluid is used for temperature-controlling bristle bundles situated in the bundle pockets 3, a discharge apparatus can be provided, by way of which fluid heated by the heating apparatus 4, in particular warm air, can be discharged.

However, it is typically more economical in terms of energy for the apparatus 1 to have a closed system, in particular a recirculating air system, in which fluid that is heated by the heating apparatus 4, in particular heated air, circulates.

The controller 54 and/or a regulator unit of the apparatus 1 can be used for monitoring a thermal input into the bundle pockets 3.

The apparatuses 1 shown in the figures can have one or a plurality of temperature sensors by way of which a temperature of the bundle pockets 3 can be determined. The temperature sensors can be disposed at different positions on the bundle pockets 3 so as to determine the temperatures of the bundle pockets 3 at different locations.

The apparatuses 1 can furthermore have at least one temperature sensor on the respective heating apparatus 4 of said apparatuses 1 and/or in or at an inflow duct and/or in or at an outflow duct through which the temperature-controlled fluid is directed for exchanging heat.

The bundle receptacles 40 are at least 20% larger than an overall cross-sectional area of individual bristle filaments which are to be introduced into these bundle receptacles 40.

The bristle bundles 2 of the bristle complement 39 can be deformed in stages and/or in groups. The inner bristle bundle 2 herein can be first deformed, and the outer bristle bundle 2 of the bristle complement 39 can be subsequently deformed.

The bristle bundles 2, prior to being introduced into the bundle receptacles 40, can be spread open and/or steam-treated and/or humidified. The bristle bundles 2 can be deformed in such a manner that said bristle bundles 2 conjointly represent a logo and/or an image.

The controller 54 and/or the heating apparatus 4 of the apparatus 1 can be set such that the bristle bundles 2 with the aid of the heating apparatus 4 can be heated according to defined thermal profile curves.

The bristle bundles 2 can also be cooled with the aid of a temperature-controlled fluid. The bristle bundles 2 can in particular be cooled by compressed air and/or by nitrogen and/or by ambient air, and/or by a cold air gun and/or a cyclone tube and/or a vortex tube.

In order for the bristle bundles 2 situated within the bundle pockets 3 to be heated, a heated fluid, in particular air, can be directed through flow ducts 56 of the bundle pockets 3. These flow ducts 56 can also be utilized for cooling the bristle bundles 2 situated within the bundle pockets 3. In this instance, a cooled fluid, in particular air, is directed through the flow ducts 56 of the bundle pocket 3 herein.

The fluid, in particular the air, for incorporating the heat, upon heating the bristle bundles 2, can be released into the environment and/or be guided in a closed system, in particular in a recirculating air system or a closed-circuit system of the respective apparatus 1.

A thermal input into the bundle pockets 3 for heating the bristle bundles 2 can be monitored by the controller 54 and corresponding temperature sensors 3.

The bundle pockets 3 are heated to a basic heat above the ambient temperature before the bristle bundles 2 are introduced into the bundle receptacles 40. This helps in reducing the cycle times.

The bristle bundles 2 can be extracted from the bundle pockets 3 even before said bristle bundles 2 have reached the final cooling temperature thereof. The method can be accelerated on account thereof.

The bristle bundles 2 have bristle filaments which can be composed of PE, PBT, PA6.10, PA6.12, PA10.10, PA4.10 and/or of a mixture and/or of a composite of said materials.

The brush manufacturing machine 18 as well as the apparatus 1 for forming bristle bundles 2 are used for manufacturing brushes 32.

FIG. 14 shows that the brush manufacturing machine 18 can establish a data connection to a computer-readable medium 51. A computer program which comprises commands which have the effect that the apparatus 1 and/or the brush manufacturing 18 carry/carries out the method described in detail above can be stored on the computer-readable medium 51.

The computer-readable medium 51 in the shown exemplary embodiment according to FIG. 14 is a data storage 52 in a cloud 53. The brush manufacturing machine 18 has a controller 54 which is equipped with a preferably wireless data interface 55. The brush manufacturing machine 18 by way of the data interface 55 can establish a data connection to the cloud 53 by way of a network, for example the internet, so as to communicate with the data storage 52 kept available there and to read the computer program from said data storage 52.

The invention relates to improvements in the technical field of the manufacture and design of brushes. An apparatus 1 for forming bristle bundles 2 is inter alia proposed as an improvement. The apparatus 1 comprises at least one bundle pocket 3 which is specified for receiving a bristle bundle 2 to be formed. The bundle pocket 3 has at least one lateral piercing 6. A displacement means 7 of the apparatus 1 can be introduced through this piercing 6 into the bundle pocket 3 so as to generate a clearance 29 within a bristle bundle 2 to be formed. The bundle pocket 3 and the bristle bundle 2 situated therein are heated by the heating apparatus 4 so as to set the shaping of the bristle bundle 2 that is predefined by the bundle pocket 3 and the displacement means 7.

LIST OF REFERENCE SIGNS

1 Apparatus for forming bristle bundles
2 Bristle bundle
2*a* Frustoconical bristle bundle
2*b* Helical bristle bundle
2*c* Chalice-shaped bristle bundle
3 Bundle pocket
4 Heating apparatus
5 Introduction opening
6 Lateral piercing in 3
7 Displacement means
8 Closure means
8*a* End faces of 8
9 Heat exchanger element
10 Bundle gripper
11 Bundle pocket gripper
12 Vibrator
13 Wall of 3
14 Introduction funnel
15 Exit opening
16 Machining means/cutter
17 Cooling apparatus
18 Brush manufacturing machine
19 Rotary indexing table
20 Arm of 19
21 Cassette
22 Input station
23 Bundle profiling station
24 Bundle fusing station
25 Retrieving station
26 Further processing station
27 Heating plate
28 Cooling plate
29 Clearance in 2
30 Guide for 7, 8, 10, 16
31 Free ends of bristle filaments
32 Brush
33 Bristle carrier
34 Handle
35 First closed bundle portion
36 Second closed bundle portion
37 Free end of 2
38 End of 2 proximal to the bristle carrier
39 Bristle complement
40 Bundle receptacle
40*a* Frustoconical bundle receptacle
40*b* Helical bundle receptacle
40*c* Chalice-shaped bundle receptacle
41 Group of 40
42 First cross section of 40
43 Second cross section of 40
44 Bristle carrier receptacle
45 Periphery of 44
46 Bundle receptacle portion
47 Bundle cross section
48 Bundle cross section
49 Common bundle portion
50 Common bundle receptacle portion
51 Computer-readable medium
52 Data storage
53 Cloud
54 Controller
55 Data interface
56 Flow duct in 3

The invention claimed is:

1. An apparatus (1) for forming bristle bundles (2) of a bristle complement (39) of a brush (32), the apparatus comprising:

at least two bristle bundles (2), at least one bundle pocket (3) having at least two bundle receptacles (40) configured therein;

a heating apparatus (4) configured for heating the at least one bundle pocket (3) and the bristle bundles (2) that have been incorporated into the bundle receptacles (40);

the bundle receptacles (40) are configured to be bundle-forming and, under an effect of heat dissipated by the heating apparatus (4) on the bundle pocket (3) and thus on the bristle bundles (2) situated therein, form the bristle bundles (2) that have been incorporated into the bundle receptacles (40) in comparison to a shape of said bristle bundles (2) prior to being introduced into the bundle receptacles (40) and set the shape of the bristle bundles (2) that have been incorporated into the bundle receptacles (40) to a shaping predefined by the bundle receptacles (40); and the bundle pocket (3) at least one of a) has the at least two bundle receptacles (40) which open into a common bundle receptacle portion (50), or b) has at least one bundle receptacle (40) which is configured for receiving at least two of the bristle bundles (2) and comprises a common bundle receptacle portion (50) for the at least two of the bristle bundles (2);

wherein at least one of a) at least one of the bundle receptacles (40) of the bundle pocket (3) has an introduction duct which opens into at least two ducts of the bundle receptacle that are downstream of the introduction duct, or b) the bundle pocket (3) has a bristle carrier receptacle (44) which is delimited by an encircling periphery (45).

2. The apparatus (1) as claimed in claim 1, wherein the bundle receptacles (40) are combined in at least one group (41), and at least one of a) the group (41) comprises a number of the bundle receptacles (40) that corresponds to a number of the bristle bundles (2) of a bristle complement (39) of said bristle bundles (2) that is to be formed by the apparatus (1), or b) the bundle receptacles (40) within the group (41) are disposed like the bristle bundles (2) in the bristle complement (39).

3. The apparatus (1) as claimed in claim 1 wherein at least one of the bundle receptacles (40) of the bundle pocket (3) has at least two cross sections (42, 43) which are axially spaced apart from one another relative to a longitudinal axis of the bundle receptacle (40) and which differ from one another in terms of at least one of shape or size.

4. The apparatus (1) as claimed in claim 1, wherein at least one of the bundle receptacles (40) of the bundle pocket (3) has a bundle receptacle portion (46) which is defined by envelope faces of two cones or truncated cones, and at least one of a) longitudinal central axes of the two cones or truncated cones are congruent, or b) said two cones or truncated cones have different radii.

5. The apparatus (1) as claimed in claim 1, wherein at least one of the bundle receptacles (40) of the bundle pocket (3) fans out or spreads open to form a chalice-shape or a conical shape.

6. The apparatus (1) as claimed in claim 1, wherein the at least one bundle pocket (3) at least one of a) has at least one heat exchanger element (9) that facilitates a heat exchange, or b) is provided with a surface structure that facilitates a heat exchange.

7. The apparatus (1) as claimed in claim 1, further comprising at least one of a bundle gripper (10) that is movable between an initial position and a machining position, or a bundle pocket gripper (11) that is movable between an initial position and a machining position.

8. The apparatus (1) as claimed in claim 7, wherein at least one of the at least one bundle pocket (3) the bundle pocket gripper (11), or the bundle gripper (10), is assigned a vibrator (12).

9. The apparatus (1) as claimed in claim 1, wherein at least one of a) the at least one bundle pocket (3) has a wall (13) having a constant wall thickness, or b) an inner contour of the bundle pocket (3) is adapted to an outer contour of the bundle pocket (3).

10. The apparatus (1) as claimed in claim 1, wherein at least one of a) the bundle receptacles (40) of the bundle pocket (3) has an introduction opening (5) that is provided with an introduction funnel (14), or b) the bundle pocket (3) is or forms a monolithic unit which is materially homogenous and 3D-printed.

11. The apparatus (1) as claimed in claim 10, wherein the at least one bundle pocket (3) has an exit opening (15) which is disposed in or on a side of the bundle pocket (3) that is opposite the introduction opening (5) of the bundle pocket (3).

12. The apparatus (1) as claimed in claim 1, further comprising at least one of a cutter or a grinder configured for machining the bristle bundle (2).

13. The apparatus (1) as claimed in claim 1, further comprising at least one of a) a cooling apparatus (17) for cooling the at least one bundle pocket (3), or a data interface (55) by way of which the apparatus (1) is configured for establishing a data connection to a computer-readable medium (51).

14. The apparatus (1) as claimed in claim 13, wherein at least one of a) the heating apparatus (4) extends across a region which covers an annular segment with an angular range between 180° and 270°, or b) the cooling apparatus (17) extends across a region which covers an annular segment with an angular range between 180° and 90°.

15. The apparatus (1) as claimed in claim 1, wherein the bundle pocket (3) has at least one introduction opening (5) and at least one lateral cutout (6) through which a displacement pin (7) for profiling a bristle bundle (2) that has been introduced into the bundle pocket (3) is able to be inserted into the bundle pocket (3).

16. The apparatus (1) as claimed in claim 1, wherein the apparatus (1) is configured for forming a bristle bundle (2) by introduction into the bundle pocket (3) from a non-deformed initial shape to a desired target shape under an effect of heat from the heating apparatus (4) that is dissipated to the bundle pocket (3).

17. The apparatus (1) as claimed in claim 16, wherein the bundle pocket (3) has two mutually opposite ones of the lateral cutouts (6), and at least one closure pin (8) configured for temporarily closing the at least one lateral cutout (6) of the at least one bundle pocket (3).

18. The apparatus (1) as claimed in claim 1, further comprising a bundle spreading apparatus configured for spreading the bristle bundles (2) prior to being introduced into the bundle pocket (3).

19. The apparatus (1) as claimed in claim 1, further comprising a humidification apparatus for at least one of humidifying or steam-treating the bristle bundles (2).

20. The apparatus (1) as claimed in claim 1, further comprising a controller (54) configured for actuating the heating apparatus (4) such that the bristle bundles (2) in the bundle pocket (3) are heated according to defined thermal profile curves.

21. The apparatus (1) as claimed in claim 1, wherein at least one of the heating apparatus (4) or the bundle pocket (3) are configured for heating the bristle bundles (2) by thermal conduction via at least one of mechanical contacting, induction, convection or thermal radiation.

22. The apparatus (1) as claimed in claim 1, further comprising a cooling apparatus (17) configured for cooling the bristle bundles (2) by a temperature-controlled fluid, and the cooling apparatus (17) comprises at least one of a cold air gun, a vortex tube, or a cyclone tube.

23. The apparatus (1) as claimed in claim 1, wherein the bundle pocket (3) is produced by at least one of eroding, 3D printing, cutting, or at least one of thin layers or sheets that are connected to one another.

24. The apparatus (1) as claimed in claim 1, wherein at least one of a) the bundle receptacles (40) have a surface roughness of at most 6.3 μm, b) the bundle receptacles (40) in the push-fitting direction of the bristle bundles (2) are at least one of ground or polished, or the bundle receptacles (40) have a surface coating so as to reduce a surface roughness of said bundle receptacles (40).

25. The apparatus (1) as claimed in claim 1, further comprising a suction apparatus by which a negative pressure is adapted to be applied to the bundle pocket (3) to facilitate an introduction of the bristle bundles (2).

26. The apparatus (1) as claimed in claim 1, wherein the bundle pocket (3) is at least one of a) laterally perforated, b) has at least one flow duct, or c) has at least part of the heating apparatus (4) therein.

27. The apparatus (1) as claimed in claim 1, further comprising a discharge apparatus by which fluid that is heated with the heating apparatus (4) is dischargeable, the heating apparatus (4) has a closed system in which fluid heated by the heating apparatus (4) circulates.

28. The apparatus (1) as claimed in claim 1, further comprising a controller (54) configured for monitoring a thermal input into the bundle pocket (3).

29. The apparatus (1) as claimed in claim 1, further comprising at least one temperature sensor, by which a temperature of the bundle pocket (3) is determined.

30. The apparatus (1) as claimed in claim 1, further comprising at least one temperature sensor on at least one of a) the heating apparatus (4), b) in or on an inflow duct, or c) in or on an outflow duct.

31. The apparatus (1) as claimed in claim 1, wherein a cross-sectional area of a bundle receptacle (40) is at least 20% larger than an overall cross-sectional area of individual bristle filaments which are to be introduced into the bundle receptacle (40).

* * * * *